US012747593B1

(12) United States Patent
Attias

(10) Patent No.: US 12,747,593 B1
(45) Date of Patent: Sep. 29, 2026

(54) MOUNTING ASSEMBLY FOR ATTACHING TILES TO STRUCTURES

(71) Applicant: Moshe shay Attias, Beer Sheva (IL)

(72) Inventor: Moshe shay Attias, Beer Sheva (IL)

(73) Assignee: Moshe Shay Attias, Beer Sheva (IL)

( * ) Notice: Subject to any disclaimer, the term of this patent is extended or adjusted under 35 U.S.C. 154(b) by 0 days.

(21) Appl. No.: 19/352,527

(22) Filed: Oct. 8, 2025

(51) Int. Cl.
*E04F 13/08* (2006.01)

(52) U.S. Cl.
CPC ..... *E04F 13/0835* (2013.01); *E04F 13/0816* (2013.01)

(58) Field of Classification Search
CPC ..... E04F 13/0816; E04F 13/0835
USPC ..... 52/506.05
See application file for complete search history.

(56) References Cited

U.S. PATENT DOCUMENTS 4,975,014 A * 12/1990 Rufin ..... F16B 35/00 403/30
5,065,490 A * 11/1991 Wivagg ..... G21C 11/08 29/402.09
5,259,689 A * 11/1993 Arand ..... F16D 1/033 403/337
5,788,443 A * 8/1998 Cabahug ..... F16B 37/0857 411/385
10,202,822 B2 * 2/2019 Silva ..... E21B 33/134
10,465,734 B2 * 11/2019 McClure ..... F16B 37/043
10,589,835 B2 * 3/2020 Mills ..... F16B 19/1081
10,836,463 B2 * 11/2020 Mills ..... B64C 1/18
10,913,552 B2 * 2/2021 Best ..... B64G 1/62
11,225,992 B2 * 1/2022 Bansal ..... F16B 11/006
11,549,538 B2 * 1/2023 Hill ..... F16B 5/01
11,680,406 B2 * 6/2023 Fitzthum ..... E04B 1/415 52/223.13
11,815,118 B2 * 11/2023 Chang ..... F16B 5/0607
2005/0200066 A1 * 9/2005 McClure ..... F16B 19/109 269/47
2009/0155014 A1 * 6/2009 McClure ..... F16B 33/002 411/55
2009/0169337 A1 * 7/2009 LaConte ..... F16B 21/02 411/551

(Continued)

FOREIGN PATENT DOCUMENTS

IL 200286 A 4/2014
IL 253684 B 2/2020

(Continued)

*Primary Examiner* — James J Buckle, Jr.
(74) *Attorney, Agent, or Firm* — Hoffman Warnick LLC

(57) ABSTRACT

A mounting assembly for attaching a tile to a structure is disclosed. The assembly includes an anchor rod having a distal end configured for insertion into an undercut hole formed in the tile and a proximal end configured for insertion into the structure to secure the tile thereto. A nut having a geometry corresponding to an internal cavity of the undercut hole is mountable around the distal end of the anchor rod. The nut is configured to compress for passage through an insertion opening of the undercut hole and to expand within the internal cavity to engage the cavity and prevent withdrawal of the anchor rod. The nut further permits limited movement of the anchor rod within the internal cavity. The internal cavity has a cross-sectional width greater than that of the insertion opening, enabling secure yet adjustable attachment of the tile to the structure.

15 Claims, 21 Drawing Sheets

(56) References Cited

U.S. PATENT DOCUMENTS

| | | | | |
|---|---|---|---|---|
| 2011/0008124 | A1* | 1/2011 | Niklewicz | F16B 13/0833 411/80.6 |
| 2013/0039716 | A1* | 2/2013 | McClure | F16B 33/002 411/80.1 |
| 2014/0086704 | A1* | 3/2014 | Hemingway | B22F 5/06 411/378 |
| 2016/0208839 | A1* | 7/2016 | Vidal | F16B 5/0258 |
| 2017/0248163 | A1* | 8/2017 | McClure | F16B 37/043 |
| 2019/0078600 | A1* | 3/2019 | McClure | F16B 5/0258 |
| 2025/0305293 | A1* | 10/2025 | Lamdan | E04F 13/0885 |

FOREIGN PATENT DOCUMENTS

| | | | |
|---|---|---|---|
| IL | 258454 | B | 9/2020 |
| IL | 288213 | A | 6/2022 |
| IL | 319875 | A | 5/2025 |

* cited by examiner

200

300

400

500

600

MOUNTING ASSEMBLY FOR ATTACHING TILES TO STRUCTURES

FIELD OF THE INVENTION

The present invention relates to building construction systems and, more particularly, to anchoring assemblies for securing cladding or decorative tiles to walls or other structural surfaces.

BACKGROUND OF THE INVENTION

In the construction industry, tiles used for cladding, decoration, or surface protection are commonly attached to walls using mechanical anchors or adhesive systems. Conventional methods for tile mounting include pre-casting tiles with embedded anchors, direct installation of tiles on existing walls, or using suspended support frames. These techniques, while widespread, suffer from limitations when subjected to external forces such as gravitational load, wind, seismic activity, and relative displacement, as well as internal forces such as thermal expansion and over-tightening.

Rigid anchoring methods often transfer stress to the tile body, resulting in cracking, fractions, loosening, or aesthetic distortion over time. Moreover, differential thermal expansion between the tile and the supporting structure can lead to long-term durability issues. Mechanical fasteners, when overtightened, may introduce concentrated stresses that further compromise the integrity of the tile.

There is therefore a need for a mounting assembly that enables secure attachment while allowing micro-movements to absorb or dissipate mechanical and thermal stresses.

Other objects and advantages of the invention will become apparent as the description proceeds.

SUMMARY OF THE INVENTION

The present invention discloses a mounting assembly for attaching a tile to a structure. In some embodiments, the mounting assembly includes an anchor rod having a distal end configured for insertion into an undercut hole formed in the tile and a proximal end configured for insertion into the structure to secure the tile thereto. A nut having a geometry corresponding to an internal cavity of the undercut hole is mountable around the distal end of the anchor rod. The nut is configured to compress to pass through an insertion opening of the undercut hole, expand within the internal cavity and engage the internal cavity to prevent withdrawal of the anchor rod from the undercut hole, and permit limited movement of the anchor rod within the internal cavity. In certain embodiments, the cross-sectional width of the internal cavity is greater than the cross-sectional width of the insertion opening.

According to some embodiments, the internal cavity includes a surrounding sidewall, a proximal wall in which the insertion opening is formed, and a distal wall opposite the proximal wall. When the nut is expanded within the internal cavity, it interferes with the proximal wall to prevent withdrawal of the anchor rod from the undercut hole. Clearance between the nut and at least one of the surrounding sidewall, the proximal wall, and the distal wall allows limited movement of the anchor rod within the internal cavity, providing a degree of flexibility between the tile and the structure.

In some embodiments, the mounting assembly further includes a stopper element mounted on the anchor rod and configured to limit insertion of the anchor rod into the undercut hole. The stopper element may include a washer having a diameter greater than the cross-sectional width of the insertion opening of the undercut hole. In other embodiments, a compressible material may be positioned between the nut and the stopper element to accommodate movement of the tile during thermal expansion or structural adjustment.

According to certain embodiments, the nut may include one or more flexible segments configured to radially compress during insertion through the insertion opening and to radially expand within the internal cavity to engage the internal cavity and prevent withdrawal of the anchor rod from the undercut hole. The mounting assembly may thus allow for micro-movements of the tile in response to thermal expansion, mechanical vibration, or other operational stresses, improving long-term performance and durability.

In some embodiments, a nut for attaching a tile to a structure has a geometry corresponding to an internal cavity of an undercut hole. The nut is configured to compress to pass through an insertion opening of the undercut hole, expand within the internal cavity and engage the internal cavity to prevent withdrawal of the nut from the undercut hole, and permit limited movement of the nut within the internal cavity. In certain embodiments, the cross-sectional width of the internal cavity is greater than the cross-sectional width of the insertion opening.

In other embodiments, a method of cladding a wall or surface includes drilling an undercut hole in a tile, inserting a nut of the mounting assembly into the undercut hole, inserting an anchor rod of the mounting assembly into the nut, arranging the tile in a casting mold, positioning reinforcement within the mold, and casting a wall or surface material such that the anchor rod is embedded in and secured to the cast wall or surface. This process forms a cladding system in which the tile is securely anchored to the cast structure.

In some embodiments, a similar method of cladding a wall or surface includes drilling an undercut hole in a tile, inserting an anchor rod of the mounting assembly into the undercut hole, inserting a nut of the mounting assembly into the undercut hole with the anchor rod positioned within the nut, arranging the tile in a casting mold, and arranging reinforcement for a wall or surface in the mold. The wall or surface material is then cast such that the anchor rod becomes embedded and secured within the cast structure, forming a durable cladding system with the tile anchored to the surface.

In certain embodiments, a method of cladding an existing wall or surface includes drilling an undercut hole in a tile and drilling a hole in the wall or surface to be covered. An anchor rod of the mounting assembly is fixed to the wall or surface, and a nut of the mounting assembly is inserted into the undercut hole. The tile is then attached by engaging the nut with the anchor rod fixed to the wall or surface, forming a cladding system in which the tile is secured to the surface. Optionally, one or more of a gap, insulation, sealing, or adhesive may be provided between the tile and the wall or surface to enhance thermal or acoustic performance.

According to some embodiments, a method of cladding a wall or surface includes installing a subframe on the wall or surface, where the subframe is configured to support cladding tiles. An undercut hole is drilled in a tile, a nut of the mounting assembly is inserted into the undercut hole, and an anchor rod of the mounting assembly is inserted into the nut. The anchor rod is then linked to a component configured for balancing and leveling that is connected to the subframe.

The tile is attached to the subframe to form a cladding system suspended from the subframe, which is securely fixed to the wall or surface.

In other embodiments, a method of cladding a wall or surface includes installing anchoring components, such as brackets and accessories, on the wall or surface. These components serve as a structural interface for tile anchoring. An undercut hole is drilled in a tile, a nut of the mounting assembly is inserted into the undercut hole, and an anchor rod of the mounting assembly is inserted into the nut. The anchoring component is aligned and leveled relative to the tile, and the tile is attached by engaging the nut with the anchor rod connected to the brackets and accessories, thereby forming a cladding system secured to the wall or surface.

In some embodiments, a mounting assembly for attaching a tile to a wall or surface includes an anchor rod configured for insertion into a nut positioned within an undercut hole formed in the tile. The nut is retained within an internal cavity of the undercut hole. Insertion of the anchor rod into the nut produces a snap-fit locking engagement between the anchor rod and the nut that prevents withdrawal of the anchor rod and nut from the internal cavity. The snap-fit locking engagement is achieved without threading and without the use of auxiliary tools.

According to certain embodiments, the snap-fit locking engagement is achieved as the anchor rod passes beyond lower edges of the nut, with the edges cooperating with the anchor rod to retain it within the internal cavity of the undercut hole.

The present invention addresses the limitations of existing tile anchoring systems, including pre-casting methods, direct installation on structural walls, and suspension systems. These conventional approaches often impose rigid constraints on the tile, leading to internal stresses, cracking, or displacement when subjected to thermal expansion, structural shifting, or mechanical vibration. In contrast, the present mounting assembly employs an undercut anchoring configuration in which a nut compresses to pass through a narrow opening and expands within a wider internal cavity in the tile to securely engage it without rigidly fixing the anchor rod. This allows for controlled micro-movements of the tile. A stopper element limits over-insertion of the anchor rod, while an optional compressible material between the nut and stopper absorbs mechanical and thermal stresses. By enabling movement and stress dissipation, the system enhances both the structural integrity and aesthetic stability of the tile over time, even under dynamic environmental conditions.

DETAILED DESCRIPTION OF THE INVENTION

The present invention discloses a mounting assembly for attaching a tile to a structure, comprising an anchor rod having a distal end configured for insertion into an undercut hole formed in the tile and a proximal end configured to be secured within the structure. The assembly further includes a nut positioned around the distal end of the anchor rod, the nut having a geometry corresponding to an internal cavity of the undercut hole. The nut is configured to radially compress to pass through a narrowed insertion opening of the undercut hole and to radially expand within the internal cavity to engage its inner walls, thereby preventing withdrawal of the anchor rod. This engagement allows for secure tile mounting while permitting controlled micro-movements of the tile in response to thermal expansion, displacements from external forces, or structural relative displacement. A stopper element mounted on the anchor rod limits the depth of insertion into the undercut hole, and an optional compressible or flexible material positioned between the nut and the stopper may further absorb thermal or mechanical stresses. This configuration minimizes stress concentrations on the tile, enhances structural durability, and accommodates environmental and mechanical variations without compromising alignment or appearance.

The present invention addresses the limitations of existing tile anchoring systems, including pre-casting methods, direct installation on structural walls, and suspension systems. These conventional approaches often impose rigid constraints on the tile, leading to internal stresses, cracking, or displacement when subjected to thermal expansion, structural shifting, or mechanical vibration. In contrast, the present mounting assembly employs an undercut anchoring configuration in which a nut compresses to pass through a narrow opening and expands within a wider internal cavity in the tile to securely engage it without rigidly fixing the anchor rod. This allows for controlled micro-movements of the tile. A stopper element limits over-insertion of the anchor rod, while an optional compressible material between the nut and stopper absorbs mechanical and thermal stresses. By enabling movement and stress dissipation, the system enhances both the structural integrity and aesthetic stability of the tile over time, even under dynamic environmental conditions.

Figure 1A:
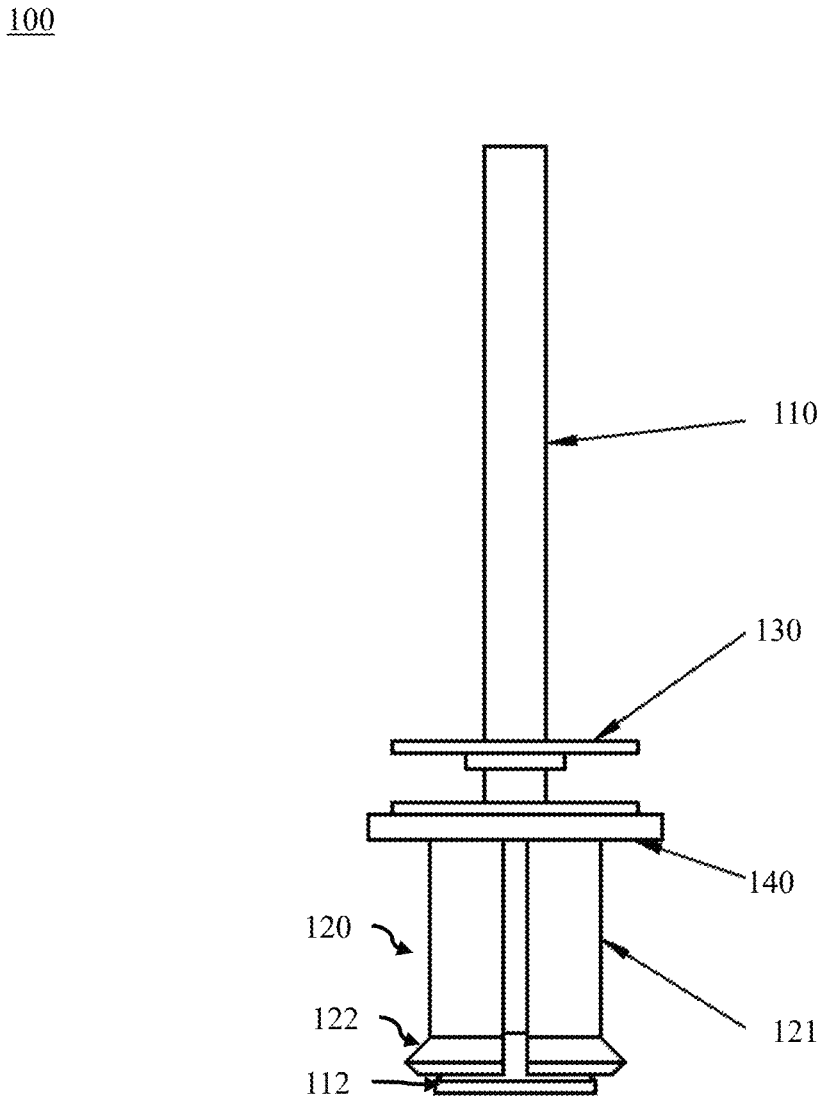
FIG. 1A is a side view of a mounting assembly for attaching a tile to a structure, according to some embodiments of the present invention.
Figure 1B:
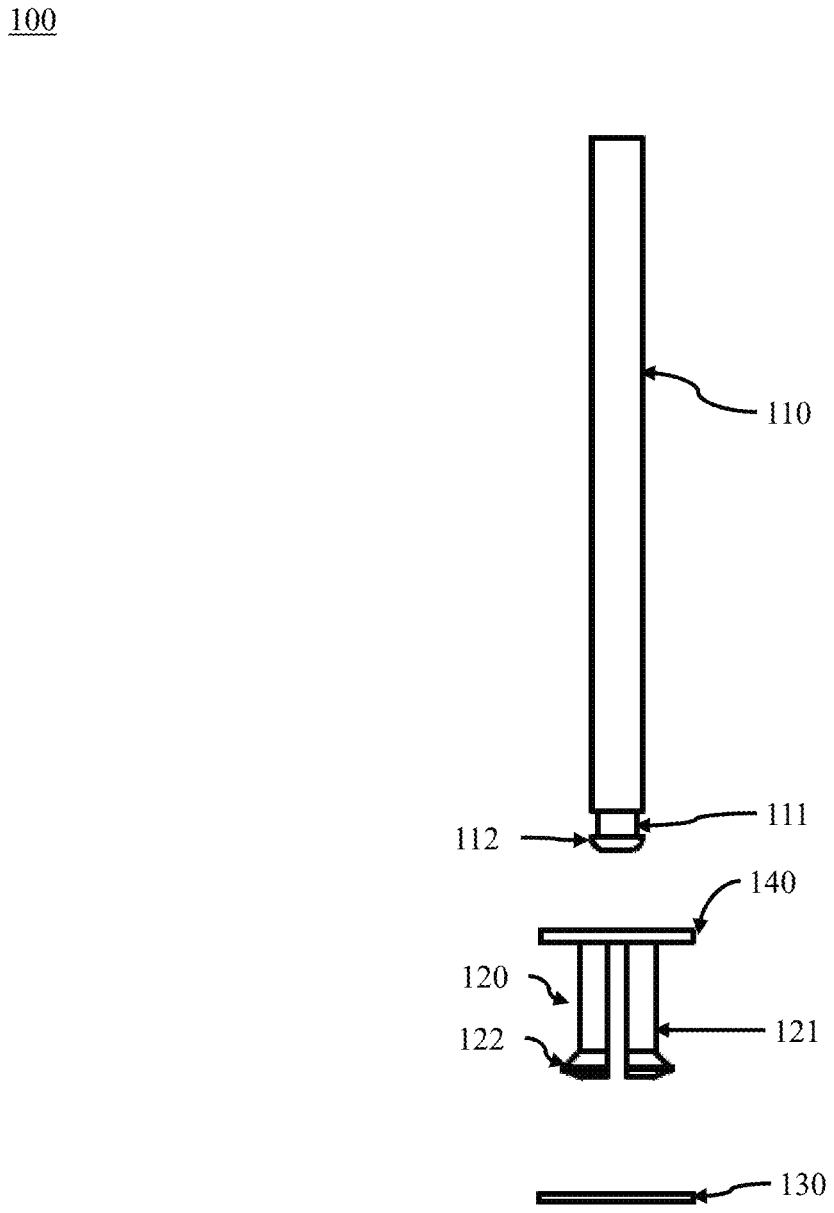
FIG. 1B is an exploded side view of a mounting assembly for attaching a tile to a structure, according to some embodiments of the present invention.
Figure 1C:
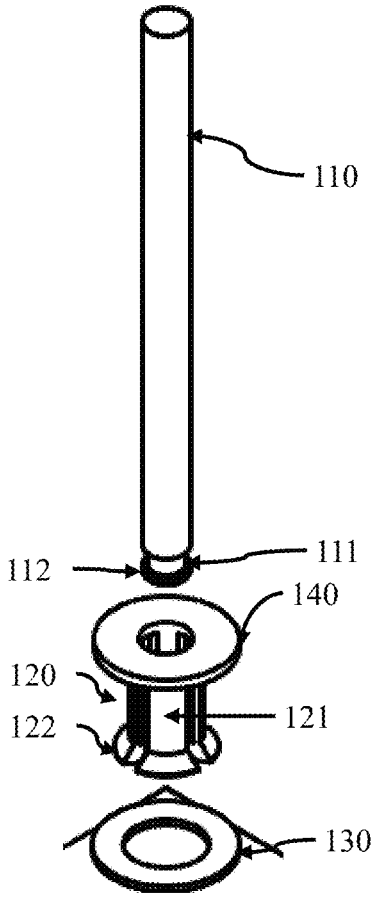
FIG. 1C is an exploded perspective view from the structure-facing (proximal) end of a mounting assembly for attaching a tile to a structure, according to some embodiments of the present invention.
Figure 1D:
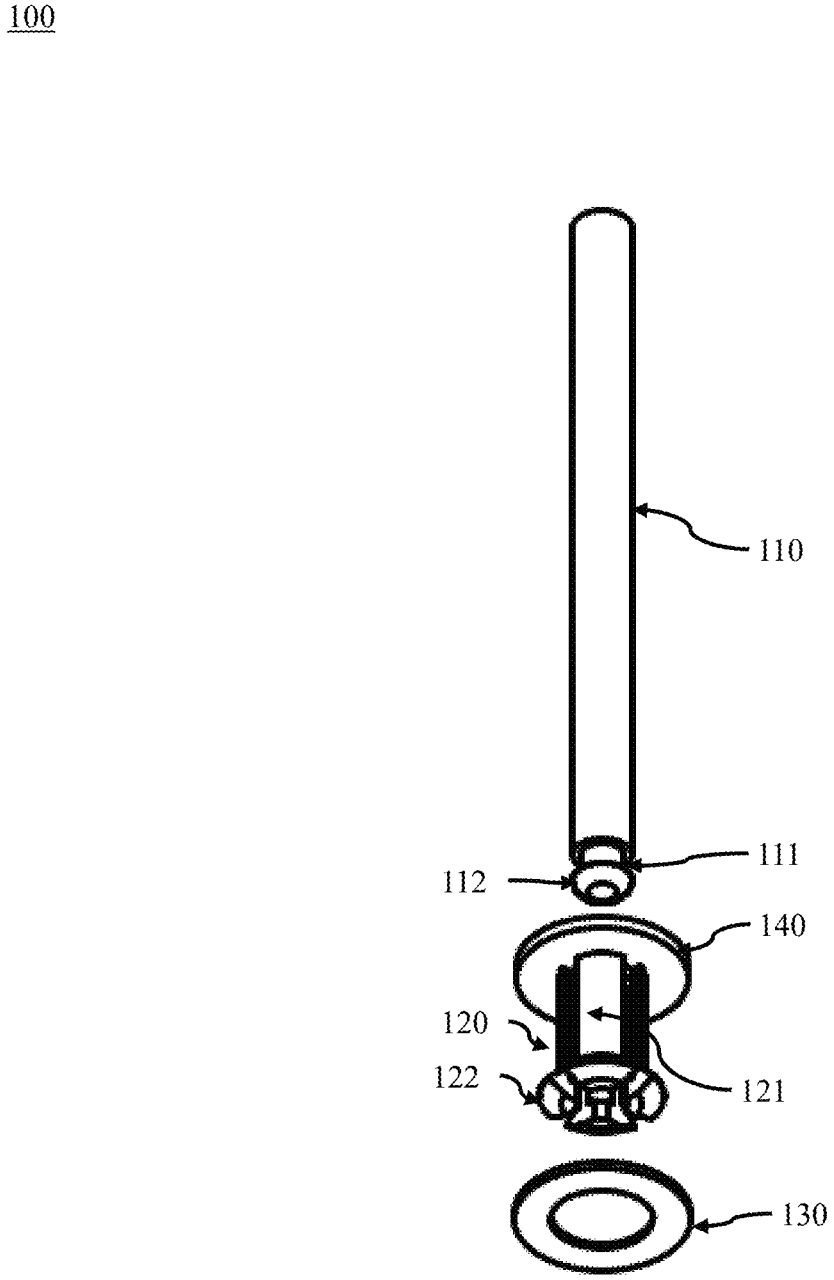
FIG. 1D is an exploded perspective view from the tile-facing (distal) end of a mounting assembly for attaching a tile to a structure, according to some embodiments of the present invention.

Reference is now made to FIGS. 1A-D. FIG. 1A is a side view of mounting assembly 100 for attaching a tile to a structure, according to some embodiments of the present invention. FIG. 1B is an exploded side view of mounting assembly 100 for attaching a tile to a structure, according to some embodiments of the present invention. FIG. 1C is an exploded perspective view from the structure-facing (proximal) end of mounting assembly 100 for attaching a tile to a structure, according to some embodiments of the present invention. FIG. 1D is an exploded perspective view from the tile-facing (distal) end of mounting assembly 100 for attaching a tile to a structure, according to some embodiments of the present invention.

Figure 2A:
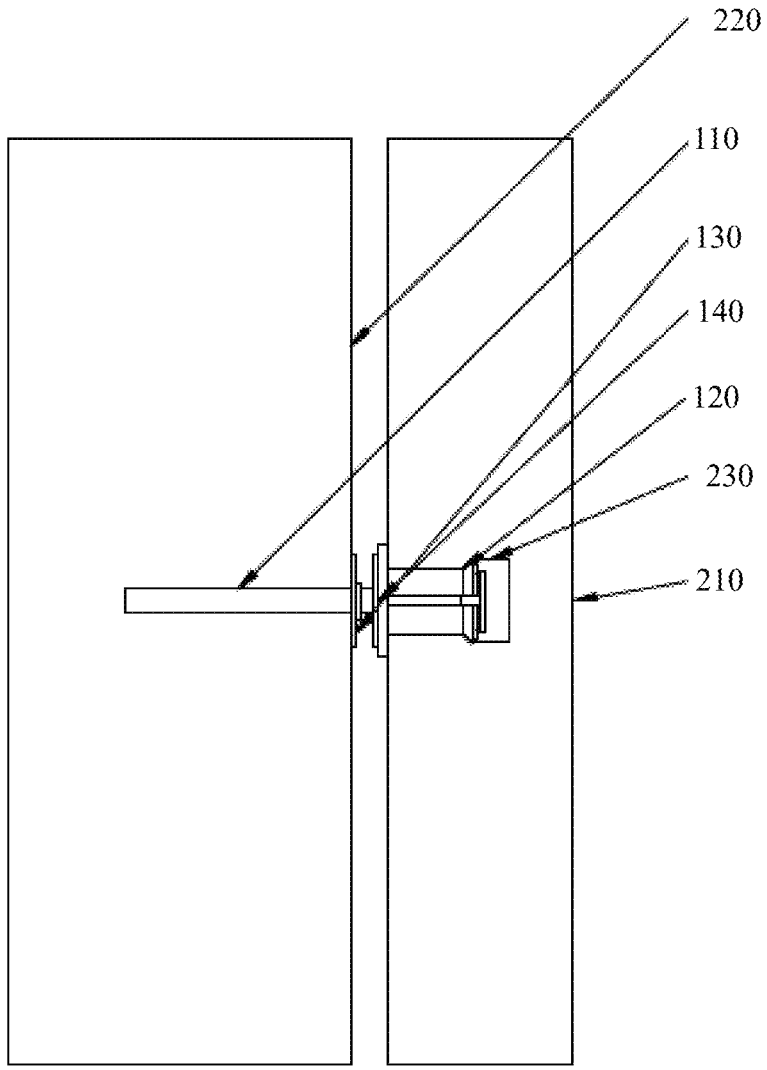
FIG. 2A is a cross-sectional side view of the mounting assembly installed between a tile and a structure, according to some embodiments of the present invention.
Figure 2B:
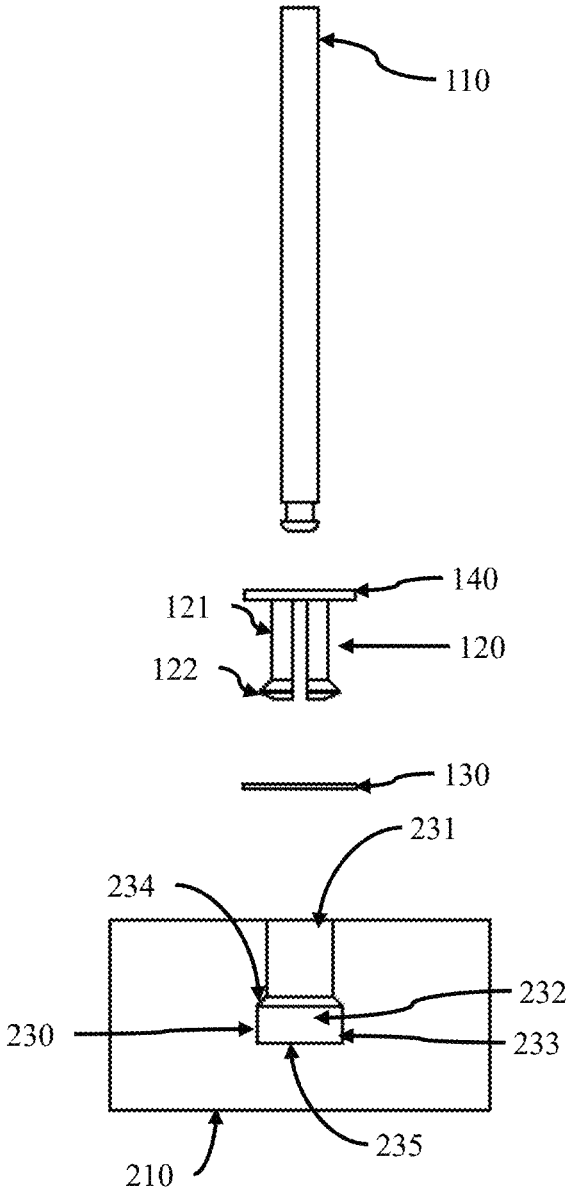
FIG. 2B is an exploded side view of the mounting assembly and a sectional view of an undercut hole, according to some embodiments of the present invention.
Figure 2C:
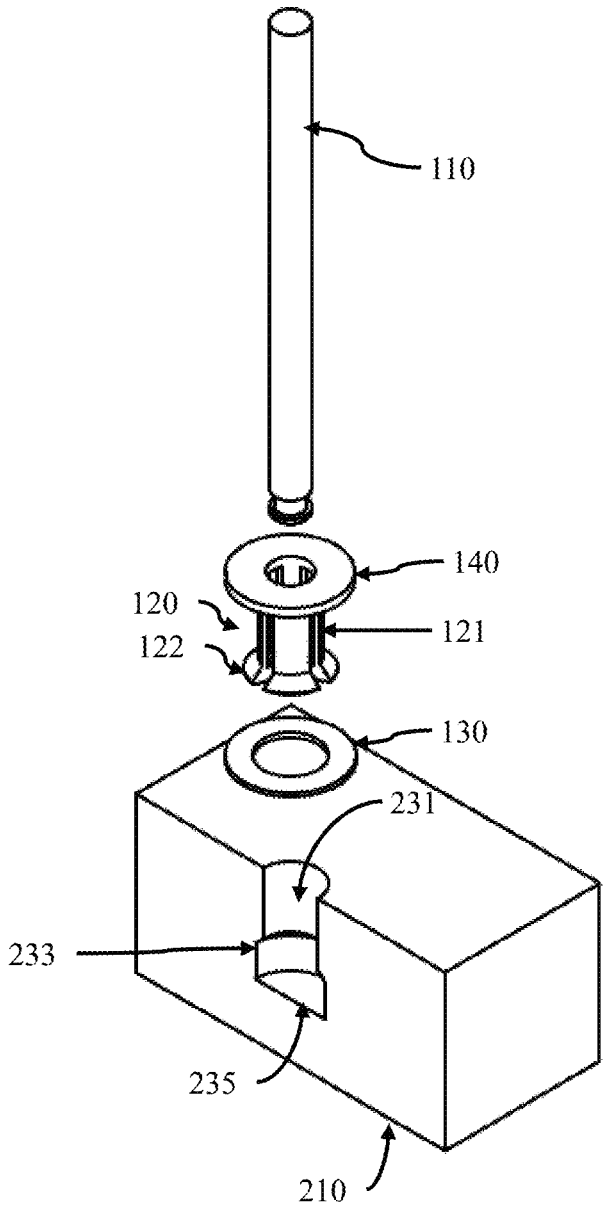
FIG. 2C is an exploded perspective view of the mounting assembly and a perspective sectional view of an undercut hole, according to some embodiments of the present invention.
Figure 2D:
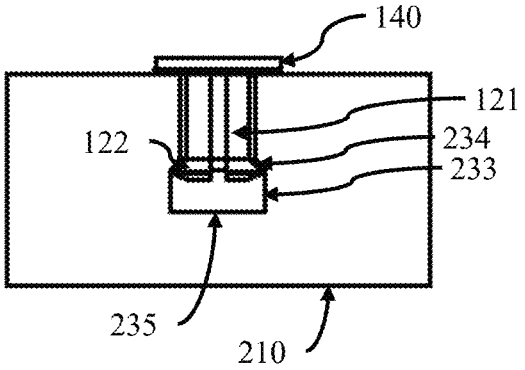
FIG. 2D is a side view of a nut of the mounting assembly and a sectional view of an undercut hole, according to some embodiments of the present invention.
Figure 2E:
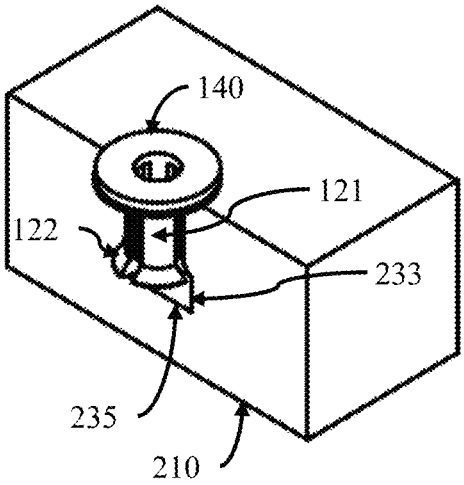
FIG. 2E is a perspective view of a nut of the mounting assembly and a perspective sectional view of an undercut hole, according to some embodiments of the present invention.

Reference is also made to FIGS. 2A-2E. FIG. 2A is a cross-sectional side view of mounting assembly 100 installed between tile 210 and structure 220, according to some embodiments of the present invention. FIG. 2B is an exploded side view of mounting assembly 100 and a sectional view of an undercut hole 230, according to some embodiments of the present invention. FIG. 2C is an exploded perspective view of mounting assembly 100 and a perspective sectional view of undercut hole 230, according to some embodiments of the present invention. FIG. 2D is a side view of nut 120 of mounting assembly 100 and a sectional view of undercut hole 230, according to some embodiments of the present invention. FIG. 2E is a perspective view of nut 120 of mounting assembly 100 and a perspective sectional view of undercut hole 230, according to some embodiments of the present invention.

According to some embodiments, the present invention discloses a mounting assembly 100 for attaching a tile (e.g., tile 210) to a structure (e.g., structure 220). The mounting assembly 100 may include anchor rod 110 having a distal end configured for insertion into an undercut hole (e.g., an undercut hole 230) formed in the tile and a proximal end configured for insertion into the structure to secure the tile thereto.

The mounting assembly 100 may include nut 120 having a geometry corresponding to an internal cavity (e.g., an internal cavity 232) of the undercut hole. The nut 120 may be mountable around the distal end of the anchor rod 110. The nut 120 may be configured to compress to pass through an insertion opening (e.g., an insertion opening 231) of the undercut hole. The nut 120 may be configured to expand within the internal cavity and engage the internal cavity to prevent withdrawal of the anchor rod from the undercut hole. The nut 120 may be configured to permit limited movement of the anchor rod 110 within the internal cavity. The internal cavity may have a cross-sectional width that is greater than the cross-sectional width of the insertion opening, allowing the nut to expand and enabling constrained movement of the rod while maintaining secure engagement with the tile.

The internal cavity of the undercut hole may include a surrounding sidewall (e.g., a surrounding sidewall 233), a proximal wall (e.g., a proximal wall 234) in which the insertion opening is formed, and a distal wall (e.g., a distal wall 235) positioned opposite the proximal wall. When nut 120 is expanded within the internal cavity, it may interfere with the proximal wall to prevent withdrawal of the anchor rod 110 from the undercut hole. Additionally, the mounting assembly 100 may allow for clearance between the nut 120 and at least one of the surrounding sidewall, the proximal wall, or the distal wall, such that limited movement of the anchor rod 110 within the internal cavity is permitted.

The mounting assembly 100 may include a stopper element 130 mounted on the anchor rod 110 and configured to limit insertion of the anchor rod 110 into the undercut hole. In some embodiments, the stopper element 130 may include a washer having a diameter greater than the cross-sectional width of the insertion opening of the undercut hole, thereby preventing the anchor rod 110 from advancing too far into the tile. A compressible material 140 may be positioned between the nut 120 and the stopper element 130 to accommodate movement of the tile. The compressible material 140 may help absorb thermal expansion, mechanical stresses, or vibration, further enhancing the durability and adaptability of the mounting assembly.

The nut 120 may include one or more flexible segments 121 that may radially compress during insertion through the insertion opening of the undercut hole and may radially expand once inside the internal cavity. This expansion may allow the nut 120 to engage the internal cavity securely and prevent the withdrawal of the anchor rod 110 from the undercut hole. The one or more flexible segments 121 may include a rim 122 that interferes with the proximal wall to prevent the withdrawal of the anchor rod 110 from the undercut hole. The overall mounting assembly may be configured to allow micro-movements of the tile relative to the structure in response to thermal expansion, mechanical vibration, or other environmental or structural forces. This flexibility helps to reduce stress accumulation within the tile and maintain long-term stability of the cladding system.

Figure 2F:
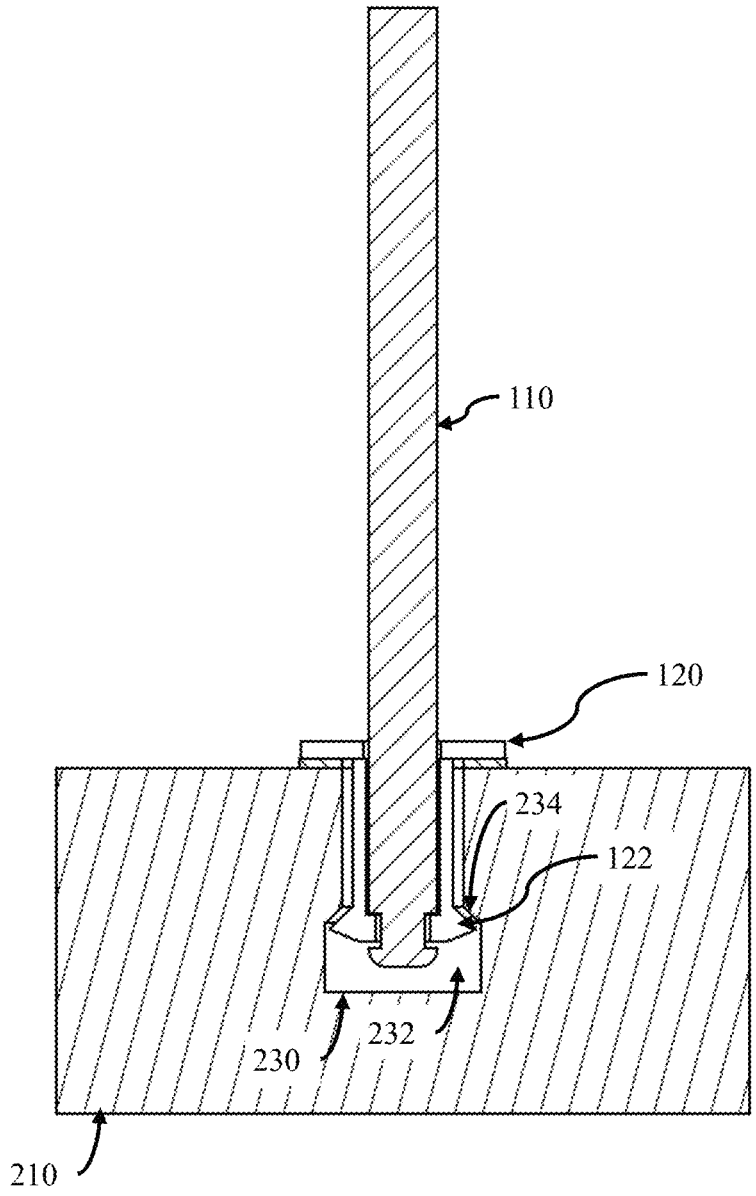
FIG. 2F is a cross-sectional side view illustrating an anchor rod engaged with a nut inserted into an undercut hole of a tile, according to some embodiments of the present invention.

Reference is now made to FIG. 2F, which is a cross-sectional side view illustrating an anchor rod 110 engaged with a nut 120 inserted into an undercut hole 230 formed in a tile 210, according to some embodiments of the present invention. The nut 120 is shown expanded within the internal cavity 232 of the undercut hole 230, securing the distal end of the anchor rod 110 in place and preventing withdrawal from the tile 210. The sectional view illustrates the engagement between the rim 122 of the nut 120 and the proximal wall 234 of the undercut hole 230, providing a concealed, mechanically secure connection that allows for precise positioning and stability of the cladding element.

In some embodiments, the mounting assembly includes a snap-fit locking engagement between the anchor rod 110 and the nut 120 positioned within the undercut hole 230 of the tile 210. Insertion of the anchor rod 110 into the nut 120 causes the nut 120 to expand or flex within the internal cavity 232 of the undercut hole 230, creating a mechanical interference that prevents withdrawal of both the nut 120 and the anchor rod 110 from the internal cavity 232. The snap-fit connection may be achieved without threading and without the use of auxiliary tools, thereby simplifying installation and reducing the risk of over-tightening or misalignment.

In certain embodiments, the snap-fit locking engagement is achieved as the anchor rod 110 passes beyond lower edges (rim 122) of the nut 120, which cooperate with the geometry of the anchor rod 110 to retain it securely within the internal cavity 232. This arrangement allows the tile 210 to be attached to the wall or surface 220 in a concealed and reliable manner while maintaining ease of assembly and consistent positioning of the cladding elements.

In some embodiments, anchor rod 110 may include a shaft with a uniform cross-sectional diameter and a head 112 at the distal end of anchor rod 110. The head 112 may have a diameter greater than that of the shaft of anchor rod 110. Anchor rod 110 may be inserted into nut 120. During insertion, flexible segments 121 of nut 120 may radially expand to allow passage of head 112 into the nut 120. Once head 112 passes beyond rim 122 of flexible segments 121, the segments may return to their original, unexpanded configuration. In this state, rim 122 may engage with head 112 to retain anchor rod 110 within the nut 120 and prevent its withdrawal from the nut 120.

In some embodiments, anchor rod 110 may include a shaft with an indent 111 formed along the shaft, thereby defining a head 112 at the distal end of anchor rod 110. Head 112 may have a diameter that is one of greater than, equal to, or less than the cross-sectional diameter of the shaft of anchor rod 110. Anchor rod 110 may be inserted into nut 120.

During insertion, flexible segments 121 of nut 120 may radially expand to allow passage of head 112 into the nut 120. Once head 112 passes beyond rim 122 of flexible segments 121, the segments may return to their original, unexpanded configuration. In this state, rim 122 may engage with head 112 and rim 111 to retain anchor rod 110 within nut 120 and prevent both its withdrawal from and further insertion into nut 120.

In some embodiments, the mounting assembly includes a "snap-fit locking engagement" "connection between the tile and the wall, which enables the tile to be securely attached to an existing wall or structure using anchors. This connection is designed to be concealed, ensuring that the attachment mechanism is not visible once the tile is in place. The" snap-fit locking engagement"" connection is achieved through a unique interaction between the anchor rod and the nut, allowing for a quick and secure installation without the need for visible fasteners, while maintaining the integrity and aesthetic of the structure.

In some embodiments, a locking mechanism is incorporated between the anchor rod and the nut. This locking mechanism ensures that once the anchor rod is inserted into the internal cavity of the nut and positioned within the undercut hole, the nut expands to engage the internal cavity, preventing the withdrawal of the anchor rod from the hole. The locking mechanism provides a reliable, secure connection between the tile and the underlying structure, enhancing the stability and durability of the installation.

In some embodiments, the "snap-fit locking engagement"" action between the anchor rod and the nut functions to create a hidden locking process. When the anchor rod is inserted into the existing nut, the nut expands within the internal cavity of the undercut hole, locking the anchor rod in place. This process ensures that the anchor rod remains firmly secured, preventing any movement in or out of the hole. Importantly, this locking process is tool-free, requiring no additional tools for installation or removal, which further simplifies the assembly process while maintaining the reliability of the connection.

In some embodiments, the term "tile" refers to any type of flat, thin, and rigid material that is intended for attachment to a surface as part of a cladding or decorative system. This may include ceramic, stone, metal, or other suitable materials that can be secured using the mounting assembly described herein. It is understood that the definition of "tile" may vary depending on the specific application, with tiles ranging in size, shape, and material composition to suit different architectural and design needs.

In some embodiments, the term "base surface for anchoring" refers to any structural surface to which the tile is attached using the mounting assembly. This base surface may include, but is not limited to, ceilings, external or internal walls, or sloped surfaces designed for cladding. The base surface must be sufficiently stable and capable of supporting the anchoring system to ensure that the tile remains securely attached and does not shift or become dislodged over time. The nature and geometry of the base surface may influence the specific design and configuration of the mounting assembly.

Figure 3:
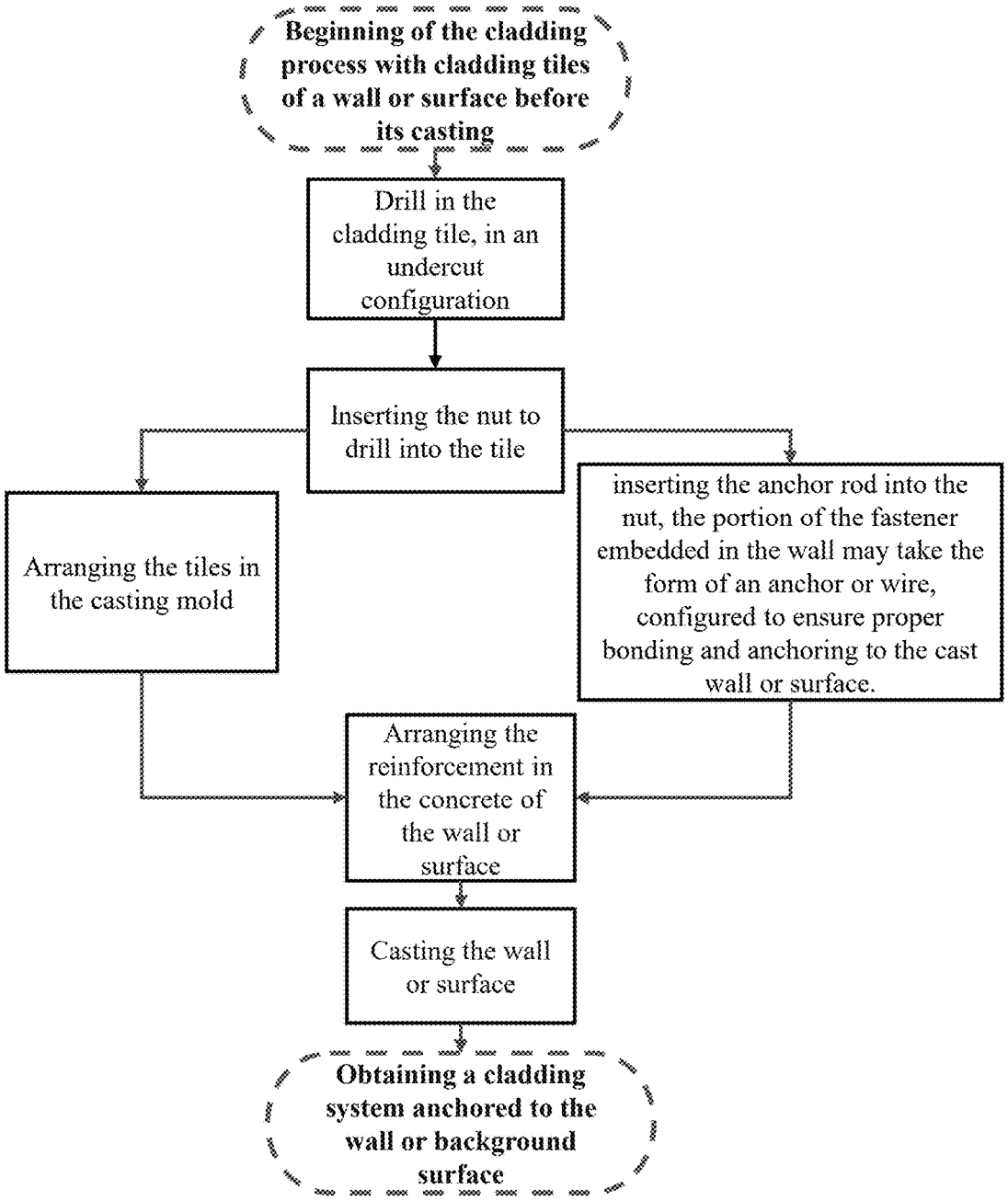
FIG. 3 illustrates a flow chart of a process for cladding a wall or surface prior to casting, according to some embodiments of the present invention.

Reference is now made to FIG. 3, which is a flow chart illustrating process 300 for cladding a wall or surface prior to casting, according to some embodiments of the present invention. Process 300 begins with initiating the cladding procedure for attaching tiles to a wall or surface before the casting process. Process 300 continues by drilling into each cladding tile to create an undercut hole configured to receive a fastening element. Process 300 proceeds by inserting a nut into the drilled undercut hole of the tile. After insertion of the nut, process 300 includes inserting an anchor rod into the nut, wherein the portion of the fastener embedded in the wall or surface may take the form of an anchor, wire, or similar structure configured to ensure secure bonding and anchoring to the wall or surface once cast.

Once the tile assemblies are prepared, process 300 continues by arranging the tiles in a casting mold in their designated layout. Process 300 then includes arranging reinforcement elements in the mold to provide structural strength to the wall or surface. After reinforcement placement, process 300 proceeds with casting the wall or surface by pouring concrete or another suitable casting material, embedding the anchoring components that secure the tiles. When the casting material cures, process 300 concludes with obtaining a cladding system securely anchored to the wall or background surface, providing a concealed, durable, and stable tile installation. Process 300 applies to both precast construction elements and on-site industrialized cladding installation methods.

Figure 4:
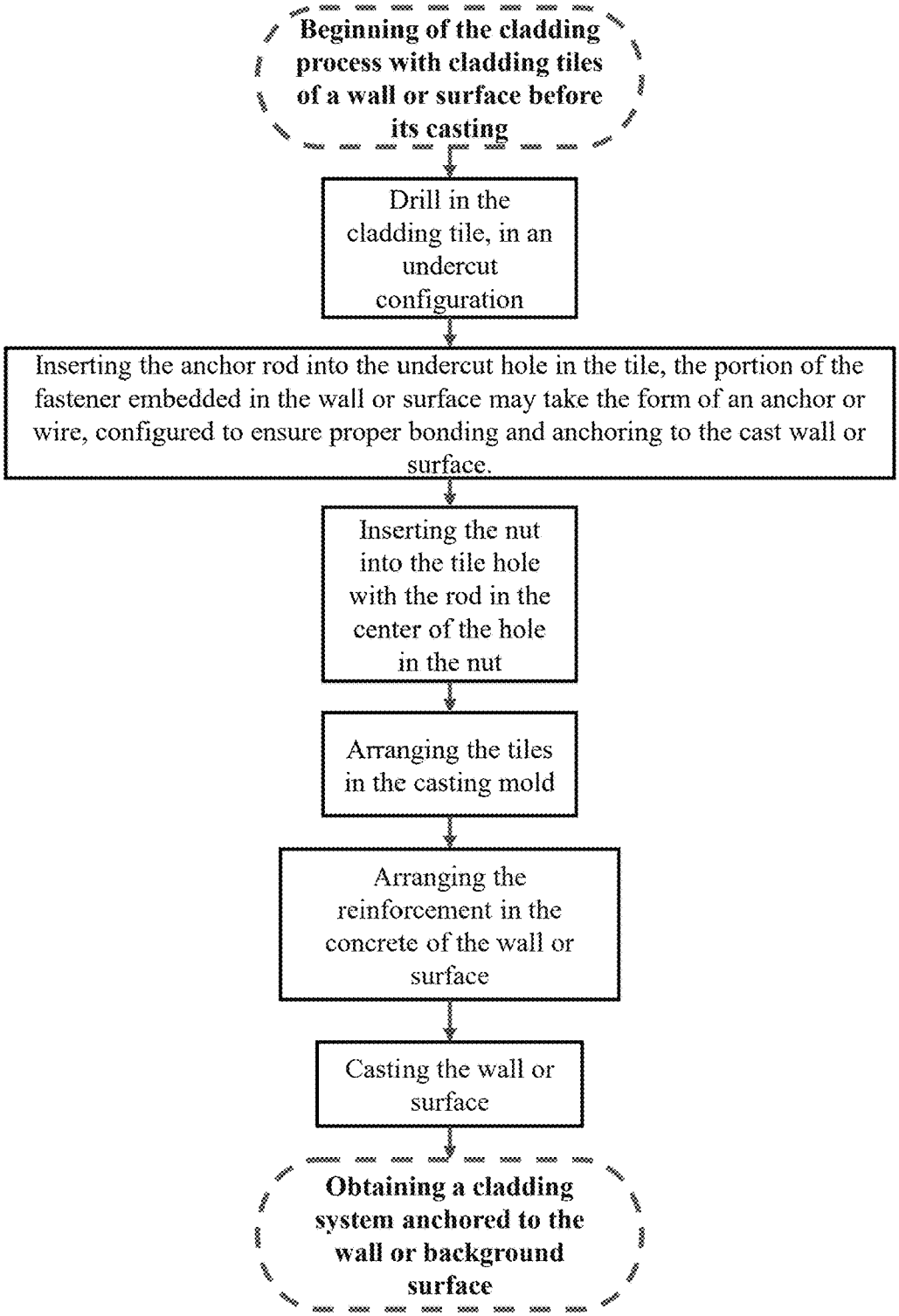
FIG. 4 is a flow chart illustrating a process for direct installation of cladding tiles onto an existing wall or surface, optionally before casting, according to some embodiments of the present invention.

Reference is now made to FIG. 4, which is a flow chart illustrating process 400 for cladding a wall or surface prior to casting, according to some embodiments of the present invention. Process 400 begins with initiating the cladding procedure for attaching tiles to a wall or surface before the casting process. Process 400 continues by drilling into each cladding tile to form an undercut hole configured to receive a fastening element.

Next, process 400 includes inserting an anchor rod into the undercut hole of the tile, wherein the portion of the fastener embedded in the wall or surface may take the form of an anchor, wire, or similar structure configured to ensure proper bonding and anchoring to the wall or surface once cast. Process 400 then proceeds with inserting a nut into the undercut hole with the rod positioned centrally within the nut to create a secure locking mechanism.

Once the fastening assembly is complete, process 400 continues with arranging the tiles in a casting mold in their designated layout. Reinforcement elements are then arranged within the mold to strengthen the wall or surface. After reinforcement placement, process 400 includes casting the wall or surface by pouring concrete or another suitable casting material, embedding the anchoring components that secure the tiles. When the casting material cures, process 400 concludes with obtaining a cladding system securely anchored to the wall or background surface, providing a robust, concealed, and stable tile installation. Process 400 applies to both precast construction elements and on-site industrialized cladding installation methods.

Figure 5:
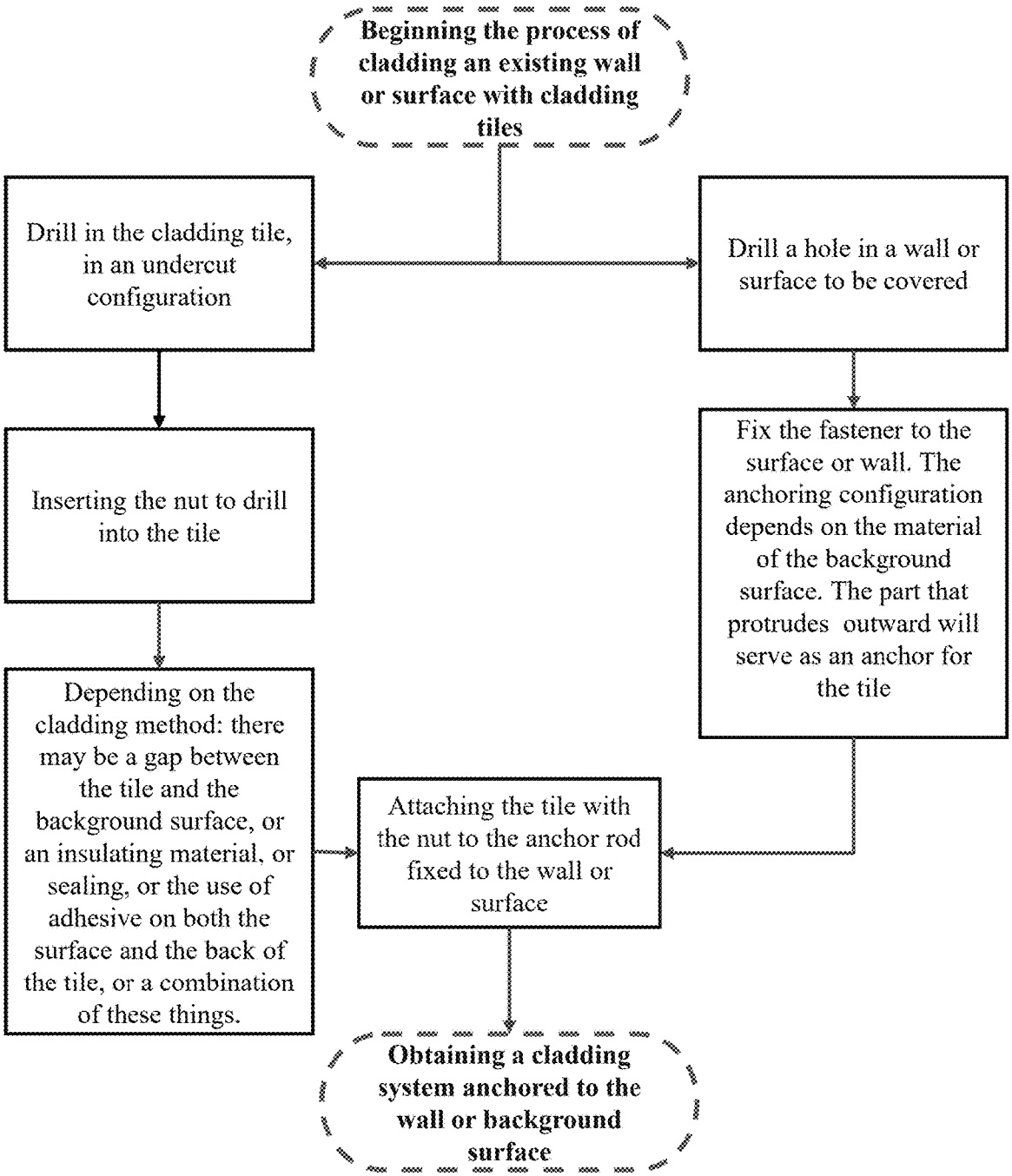
FIG. 5 is a flow chart illustrating a process for retrofitting cladding tiles onto an existing wall or surface, according to some embodiments of the present invention.

Reference is now made to FIG. 5, which is a flow chart illustrating process 500 for cladding an existing wall or surface with cladding tiles, according to some embodiments of the present invention. Process 500 begins with initiating the cladding procedure for securing tiles to an already constructed wall or surface. Process 500 continues by drilling into each cladding tile to form an undercut hole configured to receive a fastening element. In parallel, a hole is drilled in the wall or surface to be covered.

Next, process 500 includes fixing a fastener, such as an anchor or rod, to the wall or surface. The anchoring configuration may vary depending on the material and structure of the background surface, and the portion of the fastener that protrudes outward serves as an anchor point for the tile. Process 500 proceeds by inserting a nut into the undercut hole of the tile, preparing the tile for secure attachment.

Depending on the chosen cladding method, process 500 may include forming a gap between the tile and the background surface, applying insulating material, incorporating sealing elements, or using adhesives on both the back of the tile and the surface, or a combination of these techniques. The tile is then attached to the fastener by engaging the nut with the anchor rod secured to the wall or surface.

Once all tiles are installed, process 500 concludes with obtaining a cladding system securely anchored to the wall or background surface, delivering a robust, aesthetic, and concealed attachment solution suitable for retrofitting existing structures.

Figure 6:
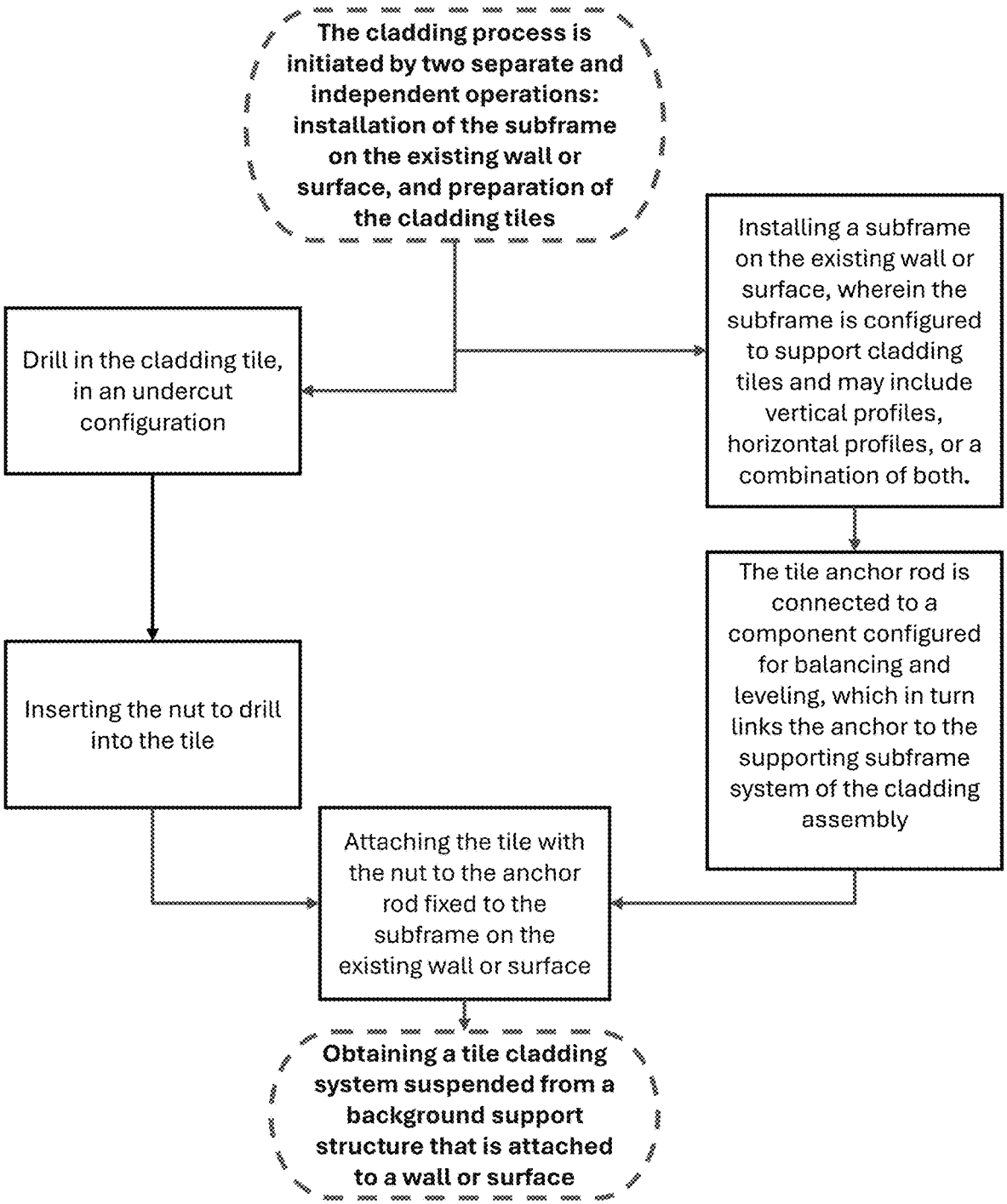
FIG. 6 is a flow chart illustrating a process for cladding installation using a subframe system, according to some embodiments of the present invention.

Reference is now made to FIG. 6, which is a flow chart illustrating process 600 for cladding a wall or surface using a subframe system, according to some embodiments of the present invention. Process 600 begins by initiating two separate and independent operations: the installation of a subframe on an existing wall or surface, and the preparation of the cladding tiles. Process 600 continues with drilling into each cladding tile to form an undercut hole configured to receive a fastening element.

In parallel, process 600 includes installing a subframe onto the existing wall or surface, wherein the subframe is configured to support the cladding tiles and may include vertical profiles, horizontal profiles, or a combination of both. Once the subframe is installed, process 600 proceeds with inserting a nut into the drilled undercut hole of each tile, preparing the tiles for attachment.

Next, process 600 includes connecting the tile anchor rod to a component configured for balancing and leveling, which links the anchor rod to the subframe system. The prepared tiles are then attached by securing the nuts and anchor rods to the subframe installed on the wall or surface. Process 600 concludes with obtaining a cladding system in which tiles are suspended from a background support structure securely attached to the wall or surface, thereby providing a concealed, adjustable, and durable installation solution.

Figure 7:
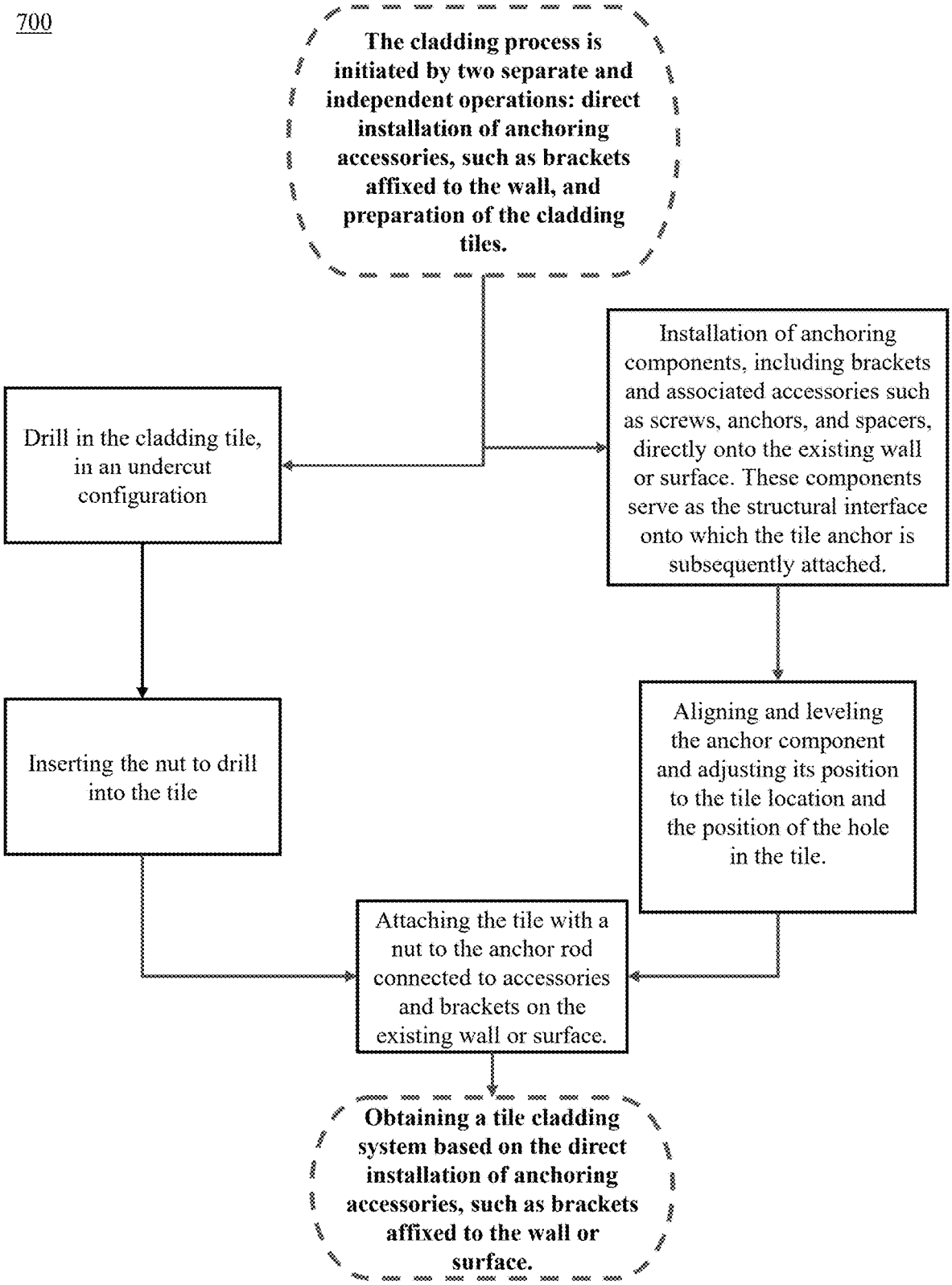
FIG. 7 is a flow chart illustrating a process for cladding installation using anchoring accessories and brackets, according to some embodiments of the present invention.

Reference is now made to FIG. 7, which is a flow chart illustrating process 700 for cladding an existing wall or surface using anchoring components, according to some embodiments of the present invention. Process 700 begins with preparing the installation site by drilling into each cladding tile to create an undercut hole configured to receive a fastening element. In parallel, process 700 includes installing anchoring components, including brackets and associated accessories such as screws, anchors, and spacers, directly onto the existing wall or surface. These components serve as the structural interface for supporting the tile anchor.

Next, process 700 proceeds with aligning and leveling the anchor component on the wall or surface and adjusting its position relative to the tile location and the position of the undercut hole in the tile. Once the anchor components are positioned, process 700 continues by inserting a nut into the undercut hole in each tile, preparing the tile for secure attachment.

Process 700 then includes attaching the tile by engaging the nut with the anchor rod that is connected to the brackets and accessories fixed on the wall or surface. Once all tiles are installed and secured, process 700 concludes with obtaining a cladding system firmly anchored to the existing wall or surface through a combination of brackets, accessories, and undercut anchoring elements, ensuring a concealed, adjustable, and robust installation.

Figure 8A:
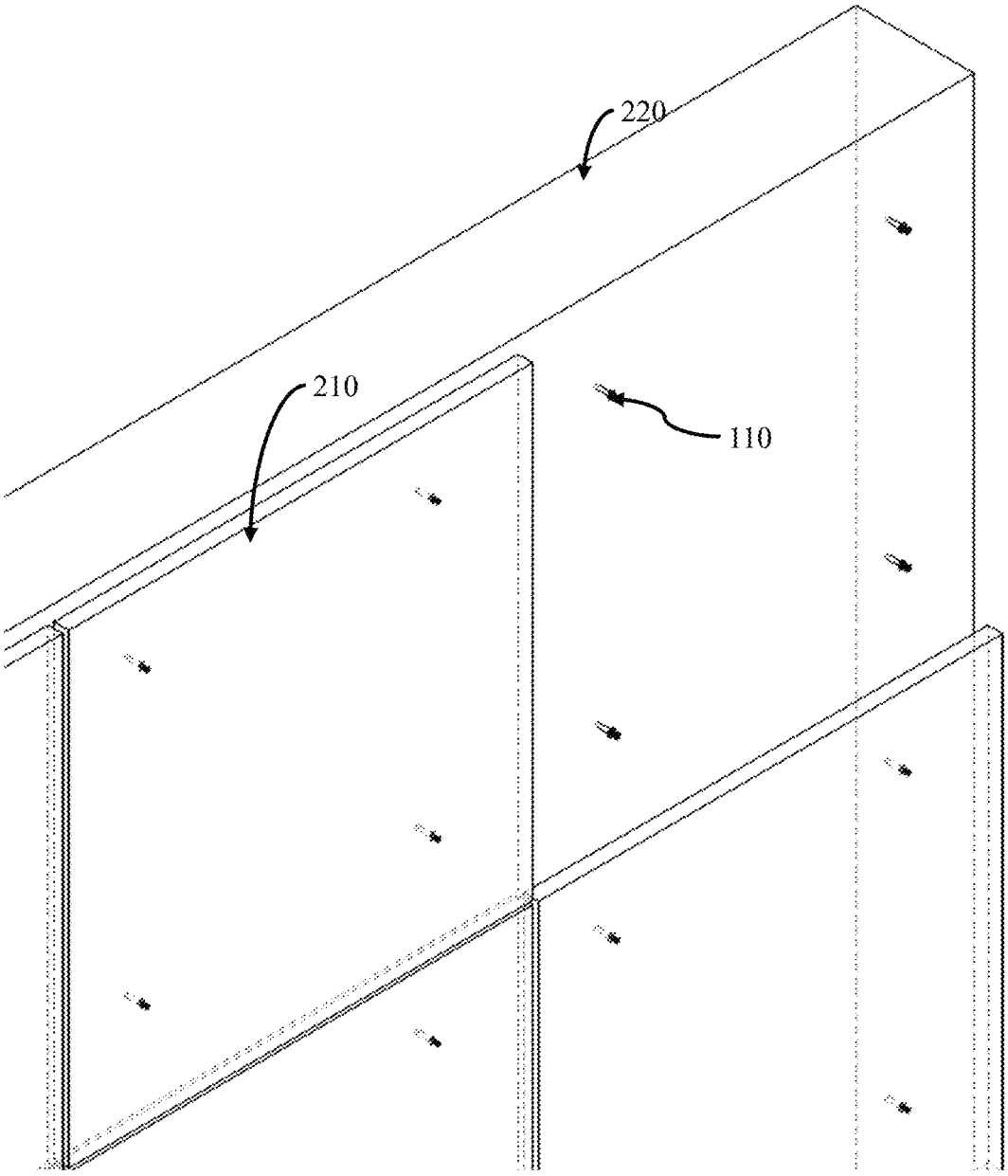
FIG. 8A is a perspective view illustrating a cladding system with direct installation using an anchor rod and nut, according to some embodiments of the present invention.

Reference is now made to FIG. 8A, which is a perspective view illustrating a cladding system with direct installation, according to some embodiments of the present invention. As shown in FIG. 8A, an anchor rod 110 and a nut 120 are depicted in an arrangement for directly securing a tile to a wall or background surface. The anchor rod 110 is configured to be anchored into the existing wall or surface, while the nut 120 is inserted into a corresponding undercut hole in the tile to enable a concealed and secure connection between the tile and the underlying structure.

FIG. 8A corresponds to the direct installation process 500. In process 500, the same anchoring components are employed for retrofitting tiles onto existing walls or surfaces, optionally incorporating sealing, spacing, or adhesive materials to enhance stability and alignment.

Together, FIG. 8A and process 500 illustrate a straightforward, concealed anchoring method for tile cladding systems that simplifies installation, provides flexibility for both pre-cast and retrofit applications, and ensures durable attachment without visible fasteners.

Figure 8B:
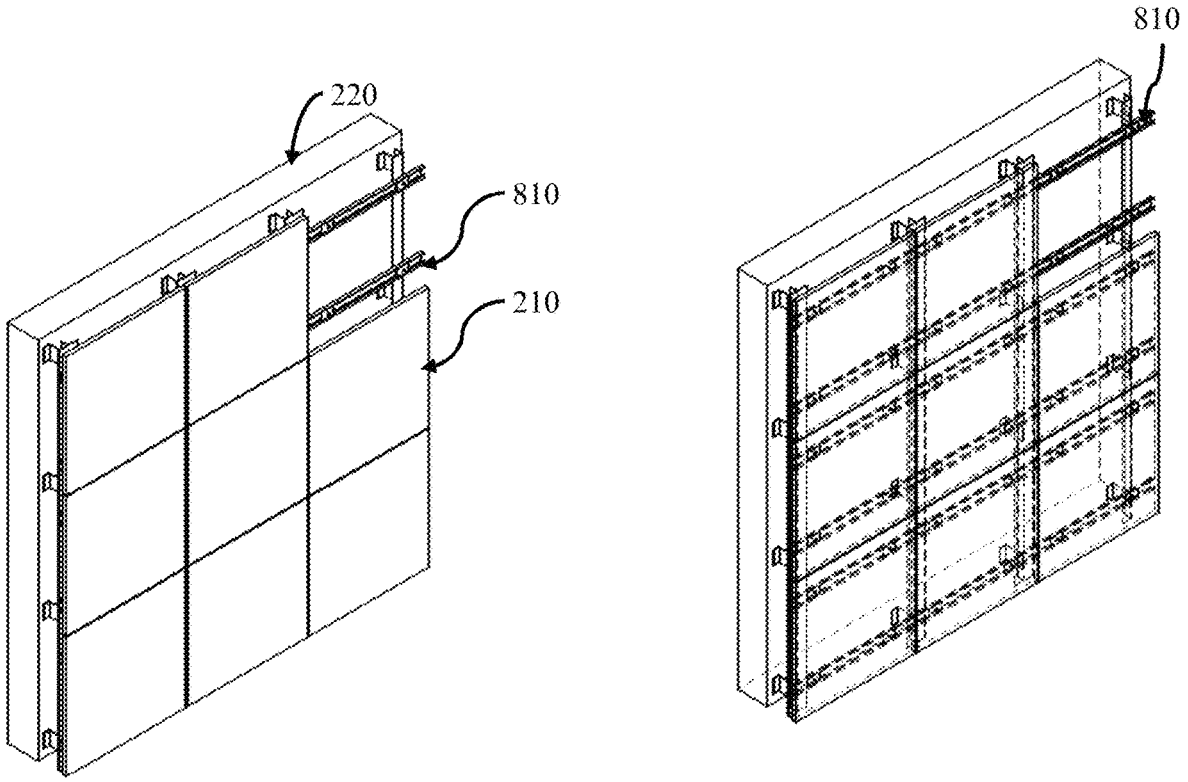
FIG. 8B is a perspective view illustrating a cladding system with a subframe, according to some embodiments of the present invention.

Reference is now made to FIG. 8B, which is a perspective view illustrating a cladding system with a subframe 810, according to some embodiments of the present invention. As shown in FIG. 8B, an anchor rod 110 and a nut 120 are employed to secure a tile to a structural subframe 810 that is mounted on an existing wall or background surface. The subframe 810 serves as an intermediary support structure for distributing loads and enabling precise alignment and leveling of cladding tiles. The nut 120 is inserted into an undercut hole in the tile, while the anchor rod 110 engages the subframe 810, providing a concealed and robust anchoring system.

FIG. 8B corresponds to process 600, which describes cladding installation using a subframe system. In process 600, the subframe 810 is first secured to the wall or background surface, providing a network of horizontal and vertical profiles for tile attachment. The tile assembly, including the nut 120 and anchor rod 110, is then connected to the subframe, often through components configured for balancing and leveling. This approach allows for high-precision alignment of tiles, accommodates variations in the wall surface, and simplifies installation on complex or uneven structures.

Together, FIG. 8B and process 600 illustrate a versatile cladding method ideal for large-scale architectural facades, suspended cladding systems, and scenarios requiring fine-tuned adjustments for design or engineering purposes.

Figure 8C:
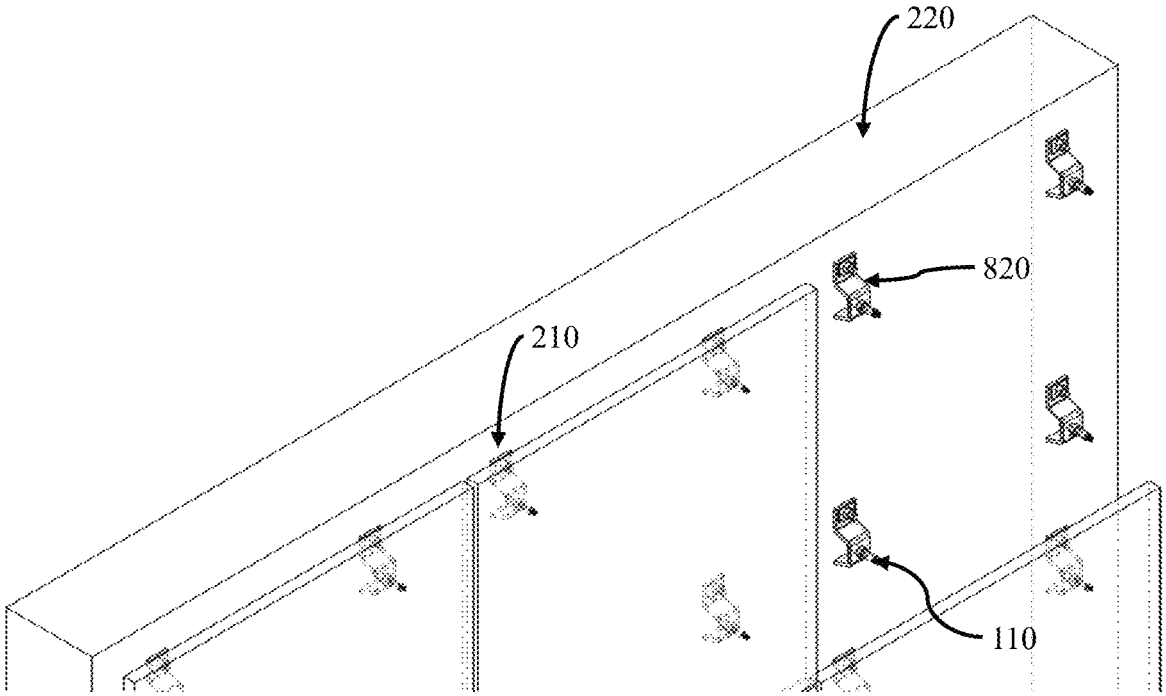
FIG. 8C is a perspective view illustrating a cladding system with anchoring accessories and brackets, according to some embodiments of the present invention.

Reference is now made to FIG. 8C, which is a perspective view illustrating a cladding system utilizing anchoring accessories and brackets 820, according to some embodiments of the present invention. As shown in FIG. 8C, a nut 120 is inserted into an undercut hole in a tile, and an anchor rod 110 extends from the nut to connect with brackets 820 that are fixed onto an existing wall or background surface. The brackets 820 act as structural intermediaries, providing a mounting point for the tile anchoring system and enabling adjustments for precise positioning.

The brackets 820 are secured to the wall with mechanical fasteners and may incorporate spacers or other accessories to compensate for surface irregularities. The anchor rod 110 engages with these brackets to securely hold each tile in place, while the concealed nut 120 inside the tile ensures a flush, aesthetically clean surface with no visible fasteners.

FIG. 8C corresponds to process 700, which describes tile installation on an existing wall or surface using a combination of brackets, accessories, and undercut anchors. This process allows for detailed adjustment of tile placement, optimal load distribution, and easy integration into various structural surfaces. The use of brackets 820 enhances precision and flexibility, making this system suitable for large-scale cladding installations requiring alignment control and modular adaptability.

Figure 9:
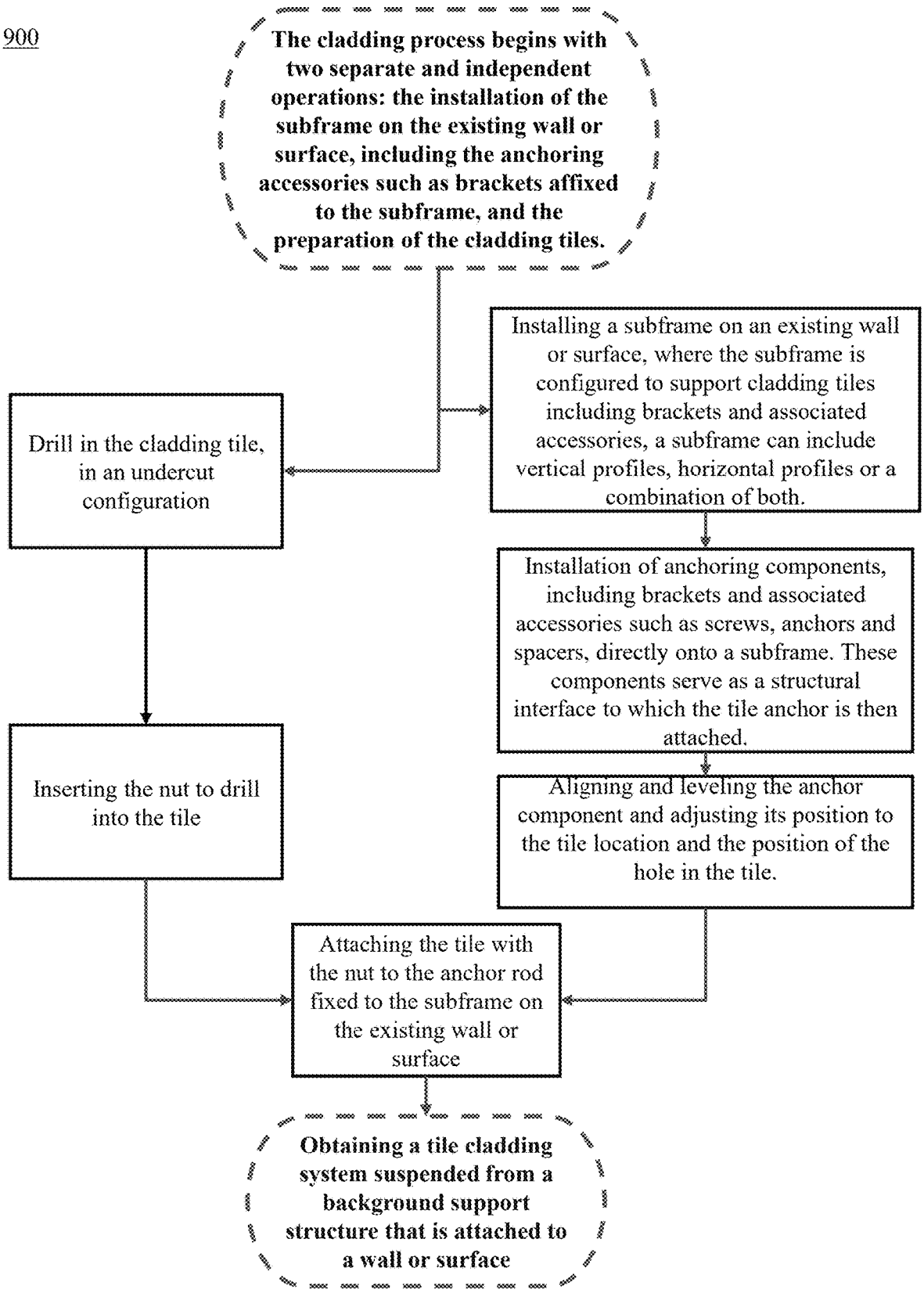
FIG. 9 is a flowchart illustrating a cladding process for an existing wall or surface with a subframe, anchoring accessories, and brackets, according to some embodiments of the present invention.

Reference is now made to FIG. 9, which is a flow chart illustrating a cladding process 900 for an existing wall or surface with a subframe, anchoring accessories, and brackets, according to some embodiments of the present invention. Process 900 provides a generalized procedure applicable to various cladding installation methods, including direct installation, subframe-supported systems, and retrofit applications.

Process 900 begins by drilling an undercut hole in a cladding tile. A nut is inserted into the drilled undercut hole, and an anchor rod is engaged with the nut to prepare the tile for attachment. The prepared tile is then secured to a wall, surface, or subframe, depending on the selected installation method. The process concludes with obtaining a cladding system in which the tile is securely anchored to the supporting structure.

Figure 10:
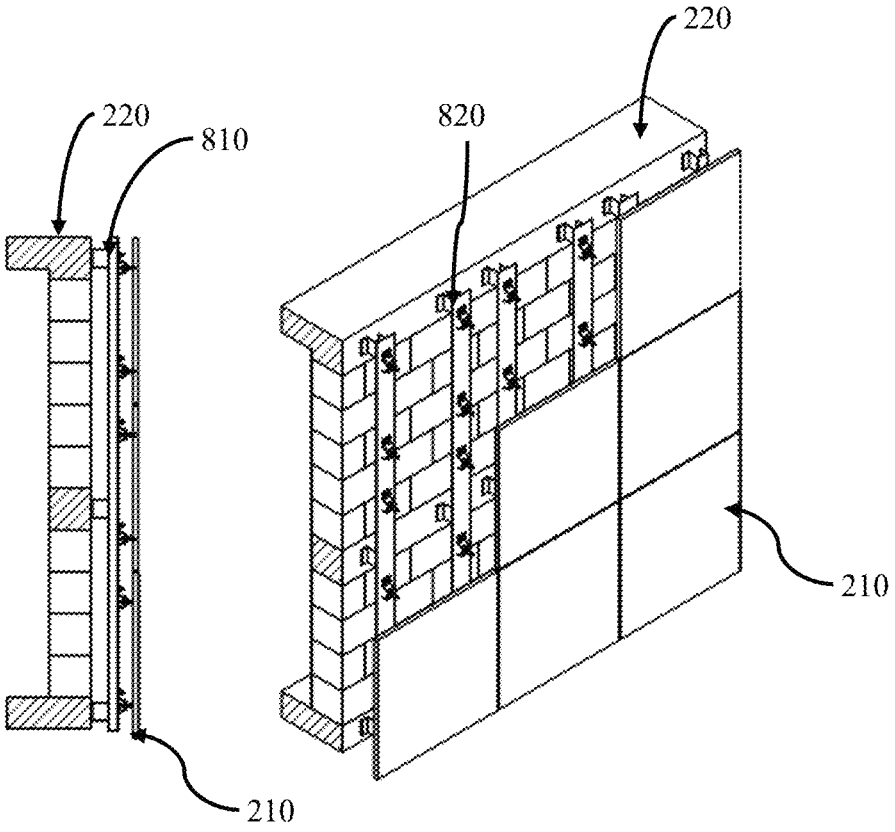
FIG. 10 includes a perspective view and a sectional view illustrating a cladding system mounted to a wall or surface using a subframe and brackets, according to some embodiments of the present invention.

Reference is now made to FIG. 10, which includes a perspective view and a sectional view illustrating a cladding system mounted to a wall or surface 220 using a structural subframe 810 and a plurality of brackets 820, according to some embodiments of the present invention. The subframe 810 is fixed to the wall or surface 220 and serves as a structural support for the cladding tiles. The brackets 820 are attached to the subframe and provide mounting points for engaging the anchoring assemblies installed in the tiles.

In this configuration, the anchor rods and nuts of the anchoring assemblies engage the brackets 820, which are secured to the subframe 810, allowing the tiles to be precisely positioned and firmly supported while maintaining a concealed fastening system. The subframe 810 and brackets 820 facilitate load distribution, adjustability, and modular installation, making the system suitable for large-scale cladding projects, retrofit applications, and installations requiring precise alignment and flexibility. The arrangement shown in FIG. 10 corresponds to the procedure described in process 900, demonstrating how the anchoring assembly is implemented in a subframe-supported system.

Figure 11:
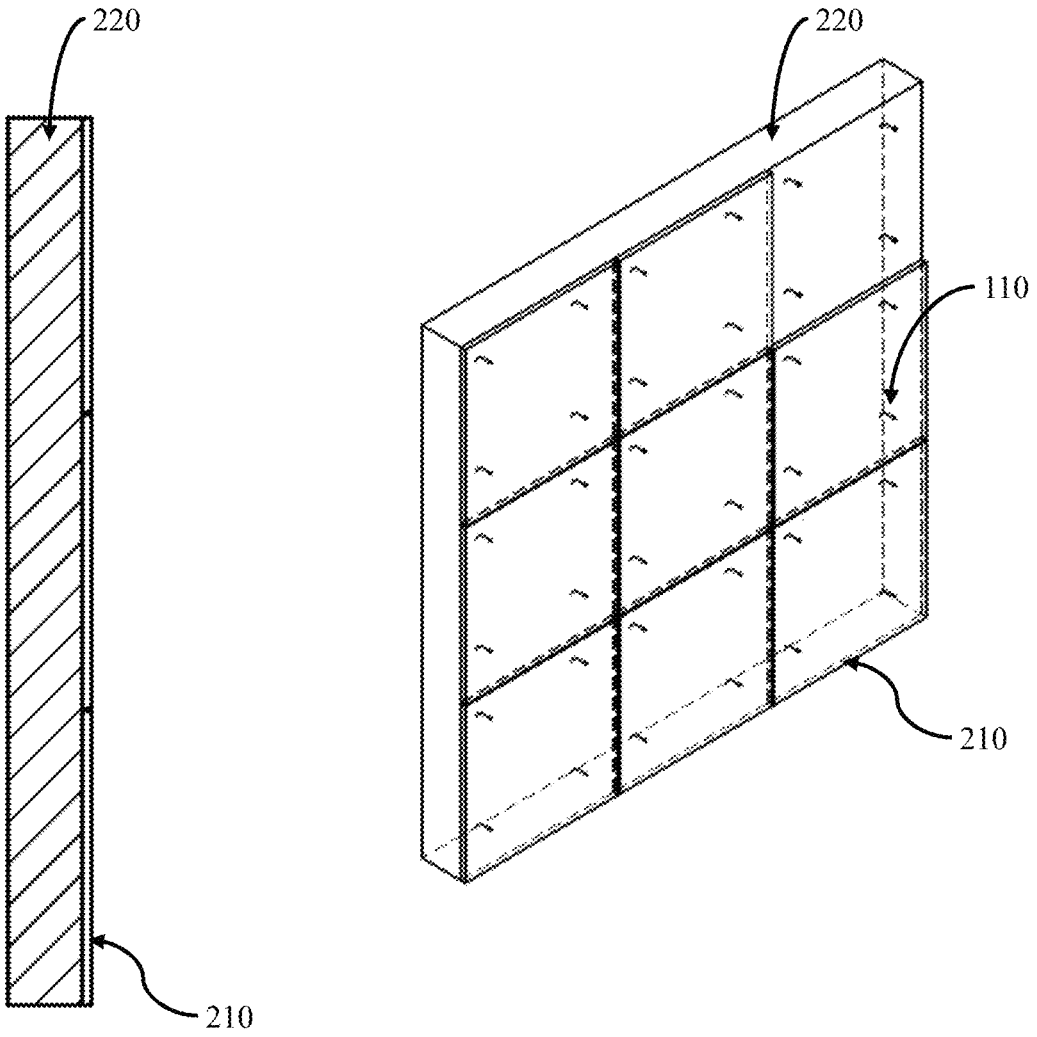
FIG. 11 includes a sectional view and a perspective view illustrating a cladding system in which a plurality of tiles are secured to a wall or surface using the anchoring assembly, according to some embodiments of the present invention.

Reference is now made to FIG. 11, which includes a sectional view and a perspective view illustrating a cladding system in which a plurality of tiles 210 are secured to a wall or surface 220 using the anchoring assembly, according to some embodiments of the present invention. The sectional view illustrates a tile attached to the wall or surface 220 with the anchoring components concealed within the tile body. The perspective view shows an array of tiles mounted on the surface, each supported by an anchor rod 110 and a nut inserted into undercut holes formed in the tiles, with all anchoring elements concealed to achieve a flush and uniform architectural finish.

This configuration demonstrates a concealed fastening approach in which the anchoring assembly is fully integrated into the tile, enhancing the durability and aesthetics of the cladding system while minimizing visible hardware. The arrangement shown in FIG. 11 corresponds to the installation methods described in processes 300 and 400, illustrating the application of the anchoring assembly for both precast wall elements and elements and on-site industrialized cladding methods.

As used herein, the term "cladding tile" (also "building cladding tile") refers to a substantially planar or slightly contoured element configured for installation on a building surface—such as an exterior or interior wall—to form a protective and/or decorative cladding layer. A cladding tile may be fabricated from a wide and continuously evolving range of materials, including, without limitation, ceramic, porcelain, natural stone, concrete, glass, metals, composite materials, engineered stone (e.g., quartz-based), acrylic solid surfaces, polymers, recycled materials, nano-composites, or combinations thereof. New materials and manufacturing techniques may likewise be used, such as high-pressure sintering, resin infusion, additive manufacturing (3D printing), and environmentally sustainable production processes.

The cladding tile may optionally include coatings or surface treatments that impart specific properties, including hydrophobicity, anti-graffiti performance, thermal or acoustic insulation, fire resistance, or enhanced durability.

In some embodiments, a cladding tile is defined by geometric dimensions that facilitate modular installation or custom-fit assembly within architectural cladding systems. The tile may incorporate features such as recesses, projections, grooves, holes, or integrated profiles configured to improve mechanical anchoring, facilitate alignment, and/or enable secure connection to a supporting framework or substrate.

The primary function of the cladding tile is to contribute to the building envelope by providing protection against weathering, moisture ingress, UV radiation, and mechanical wear, while also delivering a desired architectural appearance or finish.

Installation methods may include adhesive bonding, mechanical fastening systems (including ventilated rainscreen or "dry" cladding systems, direct installation, or combinations thereof), with selection dependent on material, thickness, weight, and structural requirements.

In various embodiments, a cladding tile may be secured using one or more mechanical anchors, including configurations with a single anchor or multiple anchors distributed across the tile surface. The number, type, and placement of anchors may vary according to structural requirements, tile dimensions, material properties, and the selected installation method.

The anchoring assembly described herein may be implemented using various anchoring methods and configurations, depending on design choices, materials, substrate conditions, and installation context. The following international and regional standards and technical documents may, where relevant, be consulted for testing, performance evaluation, and conformity assessment of particular components or assemblies. These documents are cited as non-limiting references; none of them defines, limits, or is required by the claimed invention.

European standards include EN 1992-4, Eurocode 2 for the design of fastenings in concrete; EAD 330232-00-0601, relating to mechanical metal anchors for use in concrete; EAD 330499-00-0601, for bonded anchors in concrete; ETAG 001, Annex C, a historic but still referenced guideline for anchor performance evaluation; and EAD 330030-00-0601, for undercut anchors used in ventilated façade systems. Cladding-specific documents include EAD 090062-00/01-0404, which addresses ventilated cladding kits for mechanically fixed rainscreens; ETAG 034, Parts 1 and 2, a historic but still-cited guideline for kits used in external wall cladding; EAD 090097-00-0404, which relates to cladding kits glued to subframes; EAD 090125-00-0404, for composite or multilayer rigid cladding kits; EN 13364, which sets methods for determining the breaking load at dowel holes in natural stone; EN 14411, covering ceramic tile definitions, classification, and characteristics; and the EN 1090 series, relating to execution of steel and aluminium structures, including subframes and supports.

In the United Kingdom, relevant documents include the BS 8298 series, a code of practice for the design and installation of natural stone cladding, with Part 1 providing general principles, Part 2 addressing traditional handset external cladding, Part 3 covering stone cladding on precast concrete backing, and Part 4 covering stone cladding on rainscreen support systems. Additional British standards include BS EN 845-1, which addresses ancillary components for masonry, such as wall ties, straps, and fixings, and the BS 5385 series, a code of practice for wall and floor tiling, including external ceramic and porcelain tiling but excluding adhesives.

United States standards and guidelines include ASTM E488/E488M for evaluating the strength of anchors in concrete elements; ASTM E1512, which sets test methods for mechanical fasteners in concrete; ACI 318, Chapter 17, which provides design provisions for anchoring to concrete; ACI 355.2, a standard for qualification of post-installed mechanical anchors in concrete; ACI 355.4, for qualification of post-installed adhesive anchors in concrete; ICC-ES AC193, an acceptance criterion for mechanical anchors in concrete; and ICC-ES AC308, covering adhesive anchors. For natural stone cladding, applicable documents include ASTM C1242, a guide for selecting, designing, and installing exterior dimension stone anchoring systems; ASTM C1201, which covers structural performance of exterior stone cladding systems under uniform static air pressure; and ASTM C1354, for evaluating the strength of individual stone anchorages. For ceramic and porcelain tile cladding, including gauged porcelain tiles and panels (GPTP), relevant standards include the ANSI A108 series for installation methods (excluding adhesives), ANSI A137.3 for gauged porcelain tile and panel product standards, ANSI A108.19 for interior installation of gauged porcelain panels, and ANSI A108.20 for exterior installation of such panels.

The foregoing list is not exhaustive. Equivalent or successor standards, regional adaptations, and project-specific specifications may be applied according to jurisdiction and engineering requirements. Any reference to a standard herein is intended for context and does not imply that compliance with such a standard is a limitation of, or prerequisite to, the claimed invention.

The foregoing embodiments illustrate various anchoring configurations and installation approaches, including direct attachment, subframe-supported systems, and bracket-based assemblies. To further clarify the terminology used in connection with these systems, the following description defines the role and characteristics of brackets and accessories within the overall cladding structure.

Brackets and Accessories

A bracket is a structural or mechanical component, typically manufactured from metal (though it may also be fabricated from other suitable materials), designed to support or connect cladding panels directly to a wall or building substrate. Brackets are anchored to the wall or surface using fasteners such as screws or bolts and generally feature a bent or profiled geometry to allow for precise positioning and load transfer. In some embodiments, brackets may include threaded rods, slots, or adjustment screws to facilitate vertical and/or horizontal alignment of the cladding elements.

In the context of wall cladding systems, accessories refer to complementary mechanical components that support or enhance the function of the primary anchoring elements, such as brackets. Accessories may include fasteners (screws, bolts), anchors, washers, spacers, alignment devices, clips, and other components configured to ensure secure attachment, structural stability, and accurate positioning of the cladding tiles. Accessories are selected based on factors such as substrate type, load requirements, and the specific design of the cladding system.

All of the above descriptions, examples, and embodiments have been provided for the purpose of illustration and understanding of the principles of the invention, and are not intended to limit the scope of the invention in any way. Variations, modifications, and substitutions may be made by those skilled in the art without departing from the spirit or scope of the invention as defined by the appended claims. The invention is intended to encompass all such alternatives, equivalents, and variations that fall within the true scope of the claims.

The invention claimed is:

1. A mounting assembly for attaching a tile to a structure, comprising:

a) an anchor rod having:

i) a distal end configured for insertion into an undercut hole formed in the tile; and ii) a proximal end configured for insertion into the structure to secure the tile thereto; and b) a nut having a geometry corresponding to an internal cavity of the undercut hole, wherein the nut is mountable around the distal end of the anchor rod and is configured to:

i) compress to pass through an insertion opening of the undercut hole;

ii) expand within the internal cavity and engage the internal cavity to prevent withdrawal of the anchor rod from the undercut hole; and iii) permit limited movement of the anchor rod within the internal cavity, wherein a cross-sectional width of the internal cavity is greater than a cross-sectional width of the insertion opening.

2. The mounting assembly of claim 1, wherein the internal cavity comprises a surrounding sidewall, a proximal wall in which the insertion opening is formed, and a distal wall opposite the proximal wall;

wherein the nut, when expanded within the internal cavity, is configured to interfere with the proximal wall to prevent withdrawal of the anchor rod from the undercut hole; and wherein clearance between the nut and at least one of the surrounding sidewall, the proximal wall, and the distal wall permits limited movement of the anchor rod within the internal cavity.

3. The mounting assembly of claim 1, comprising a stopper element mounted on the anchor rod and configured to limit insertion of the anchor rod into the undercut hole.

4. The mounting assembly of claim 3, wherein the stopper element comprises a washer having a diameter greater than the cross-sectional width of the insertion opening of the undercut hole.

5. The mounting assembly of claim 3, comprising a compressible material positioned between the nut and the stopper element and configured to accommodate movement of the tile.

6. The mounting assembly of claim 1, wherein the nut comprises one or more flexible segments configured to radially compress during insertion through the insertion opening, and to radially expand within the internal cavity to engage the internal cavity and prevent withdrawal of the anchor rod from the undercut hole.

7. The mounting assembly of claim 1, wherein the mounting assembly allows for micro-movements of the tile in response to at least one of: thermal expansion and mechanical vibration.

8. A nut for attaching a tile to a structure, comprising:

a) a geometry corresponding to an internal cavity of an undercut hole, wherein the nut is configured to:

i) compress to pass through an insertion opening of the undercut hole;

ii) expand within the internal cavity and engage the internal cavity to prevent withdrawal of the nut from the undercut hole; and iii) permit limited movement of the nut within the internal cavity, wherein a cross-sectional width of the internal cavity is greater than a cross-sectional width of the insertion opening.

9. A method of cladding a wall or surface, comprising:

drilling an undercut hole in a tile;

inserting a nut of the mounting assembly of claim 1 into the undercut hole;

inserting an anchor rod of the mounting assembly into the nut;

arranging the tile in a casting mold;

positioning reinforcement in the mold; and casting a wall or surface material such that the anchor rod is embedded in and secured to the cast wall or surface, thereby forming a cladding system with the tile anchored to the wall or surface.

10. A method of cladding a wall or surface, comprising:

drilling an undercut hole in a tile;

inserting an anchor rod of the mounting assembly of claim 1 into the undercut hole;

inserting a nut of the mounting assembly into the undercut hole with the anchor rod positioned within the nut;

arranging the tile in a casting mold;

arranging reinforcement for a wall or surface in the casting mold; and casting a wall or surface material such that the anchor rod is embedded in and secured to the cast structure, thereby forming a cladding system with the tile anchored to the wall or surface.

11. A method of cladding an existing wall or surface, comprising:

drilling an undercut hole in a tile;

drilling a hole in the wall or surface to be covered;

fixing an anchor rod of the mounting assembly of claim 1 to the wall or surface;

inserting a nut of the mounting assembly into the undercut hole;

attaching the tile by engaging the nut with the anchor rod fixed to the wall or surface; and forming a cladding system in which the tile is secured to the wall or surface, optionally with one or more of a gap, insulation, sealing, or adhesive between the tile and the surface.

12. A method of cladding a wall or surface, comprising:

installing a subframe on the wall or surface, the subframe configured to support cladding tiles;

drilling an undercut hole in a tile;

inserting a nut of the mounting assembly of claim 1 into the undercut hole;

inserting an anchor rod of the mounting assembly into the nut;

linking the anchor rod to a component configured for balancing and leveling that is connected to the subframe; and attaching the tile to the subframe to form a cladding system suspended from the subframe, wherein the subframe is secured to the wall or surface.

13. A method of cladding a wall or surface, comprising:

installing anchoring components including brackets and accessories on the wall or surface, the components serving as a structural interface for tile anchoring;

drilling an undercut hole in a tile;

inserting a nut of the mounting assembly of claim 1 into the undercut hole;

inserting an anchor rod of the mounting assembly into the nut;

aligning and leveling the anchor component relative to the tile; and attaching the tile by engaging the nut with the anchor rod connected to the brackets and accessories, thereby forming a cladding system secured to the wall or surface.

14. A mounting assembly for attaching a tile to a wall or surface, the assembly comprising an anchor rod configured for insertion into a nut positioned within an undercut hole formed in the tile, the nut being retained within an internal cavity of the undercut hole, wherein insertion of the anchor rod into the nut produces a snap-fit locking engagement between the anchor rod and the nut that prevents withdrawal of the anchor rod and nut from the internal cavity, and wherein the snap-fit locking engagement is achieved without threading and without the use of auxiliary tools.

15. The mounting assembly of claim 14, wherein the snap-fit locking engagement is achieved as the anchor rod passes beyond lower edges of the nut, the edges cooperating with the anchor rod to retain the anchor rod within the internal cavity of the undercut hole.

* * * * *